US008878045B2

(12) United States Patent
Koseki et al.

(10) Patent No.: US 8,878,045 B2
(45) Date of Patent: Nov. 4, 2014

(54) ACOUSTIC EFFECT IMPARTMENT APPARATUS, AND PIANO

(75) Inventors: Shinya Koseki, Hamamatsu (JP); Fukutaro Okuyama, Hamamatsu (JP)

(73) Assignee: Yamaha Corporation (JP)

( * ) Notice: Subject to any disclaimer, the term of this patent is extended or adjusted under 35 U.S.C. 154(b) by 0 days.

(21) Appl. No.: 13/616,526

(22) Filed: Sep. 14, 2012

(65) Prior Publication Data

US 2013/0061734 A1 Mar. 14, 2013

(30) Foreign Application Priority Data

Sep. 14, 2011 (JP) ..... 2011-200673
Sep. 14, 2011 (JP) ..... 2011-200674
Sep. 14, 2011 (JP) ..... 2011-200675
Sep. 14, 2011 (JP) ..... 2011-200676

(51) Int. Cl.
*G10H 3/12* (2006.01)
*G10H 3/24* (2006.01)

(52) U.S. Cl.
USPC ..... 84/616; 84/622; 84/623; 84/654; 84/659

(58) Field of Classification Search
USPC ..... 84/616, 622, 623, 654, 659
See application file for complete search history.

(56) References Cited

U.S. PATENT DOCUMENTS 1,893,895 A * 1/1933 Hammond, Jr. ..... 84/723
1,893,940 A 1/1933 Hammond, Jr.
2,001,723 A * 5/1935 Hammond, Jr. ..... 84/723
3,183,296 A 5/1965 Miessner
3,571,480 A * 3/1971 Tichenor et al. ..... 84/723
3,612,741 A * 10/1971 Marshall ..... 84/723
3,742,113 A * 6/1973 Cohen ..... 84/726
4,075,921 A * 2/1978 Heet ..... 84/738
4,236,433 A * 12/1980 Holland ..... 84/726
4,245,540 A * 1/1981 Groupp ..... 84/726
4,248,120 A * 2/1981 Dickson ..... 84/726

(Continued)

FOREIGN PATENT DOCUMENTS

JP 5073039 A 3/1993
JP 2006524350 A 10/2006
WO 90/03025 A1 3/1990

OTHER PUBLICATIONS

Extended European Search Report issued Jan. 23, 2013 for EP 12184498.

(Continued)

*Primary Examiner* — David S. Warren
(74) *Attorney, Agent, or Firm* — Rossi, Kimms & McDowell LLP

(57) ABSTRACT

An acoustic effect impartment apparatus detects striking of any one of strings by a corresponding hammer in an acoustic piano like a grand piano, and vibrates a vibration section with a driving waveform signal obtained by synthesizing sine wave signals of the fundamental frequency and harmonic frequency of the hammer-struck string. Such vibration of the vibration section is transmitted to the keys via a soundboard and bridge of the piano. Thus, vibration is excited in the hammer-struck string by the striking with the hammer but also by the driving waveform signal, so that an acoustic effect corresponding to the driving waveform signal is imparted. Because the driving waveform signal is a simple signal using the sine wave signals corresponding to the fundamental frequency of the string, a natural feeling of the acoustic piano will not be lost even when the acoustic effect is imparted.

18 Claims, 13 Drawing Sheets

(56) References Cited

U.S. PATENT DOCUMENTS

| | | | | | |
|---|---|---|---|---|---|
| 4,697,491 | A | * | 10/1987 | Maloney | 84/723 |
| 4,852,444 | A | * | 8/1989 | Hoover et al. | 84/738 |
| 4,907,483 | A | * | 3/1990 | Rose et al. | 84/726 |
| 4,941,388 | A | * | 7/1990 | Hoover et al. | 84/726 |
| 5,054,361 | A | * | 10/1991 | Usa | 84/737 |
| 5,070,759 | A | * | 12/1991 | Hoover et al. | 84/726 |
| 5,123,324 | A | * | 6/1992 | Rose et al. | 84/726 |
| 5,189,242 | A | * | 2/1993 | Usa | 84/743 |
| 5,200,569 | A | * | 4/1993 | Moore | 84/723 |
| 5,233,123 | A | * | 8/1993 | Rose et al. | 84/726 |
| 5,262,586 | A | | 11/1993 | Oba et al. | |
| 5,292,999 | A | * | 3/1994 | Tumura | 84/728 |
| 5,378,850 | A | * | 1/1995 | Tumura | 84/727 |
| 5,449,858 | A | * | 9/1995 | Menning et al. | 84/727 |
| 5,523,526 | A | * | 6/1996 | Shattil | 84/728 |
| 5,585,588 | A | * | 12/1996 | Tumura | 84/726 |
| 5,932,827 | A | * | 8/1999 | Osborne et al. | 84/726 |
| 6,034,316 | A | * | 3/2000 | Hoover | 84/738 |
| 6,348,791 | B2 | * | 2/2002 | Shattil | 324/225 |
| 7,453,040 | B2 | * | 11/2008 | Gillette | 84/723 |
| 7,678,988 | B2 | * | 3/2010 | Sato et al. | 84/743 |
| 7,786,374 | B2 | * | 8/2010 | Valli et al. | 84/737 |
| 2003/0015086 | A1 | * | 1/2003 | Katz | 84/644 |
| 2004/0226433 | A1 | | 11/2004 | Carter | |
| 2007/0079693 | A1 | * | 4/2007 | Valli et al. | 84/723 |

OTHER PUBLICATIONS

Korean Office Action cited in counterpart Korean Patent Application No. 10-2012-101432 dated Jan. 9, 2014.

Korean Office Action for corresponding KR10-2012-101432, mail date Jul. 16, 2014. English translation provided.

* cited by examiner

FUNDAMENTAL CHARACTERISTIC~ vs. ~KEY TABLE

| Key No. | tuning | volume | inharmonicity parameter | velocity adjust |
|---|---|---|---|---|
| 1 | tn1 | vm1 | ih1 | va1 |
| 2 | tn2 | vm2 | ih2 | va2 |
| 3 | tn3 | vm3 | ih3 | va3 |
| ⋮ | ⋮ | ⋮ | ⋮ | ⋮ |

FUNDAMENTAL TONE OSC-vs.-KEY TABLE

| Key No. | multiple | level | phase | pitch adjust |
|---|---|---|---|---|
| 1 | mp1 | lv1 | ph1 | ps1 |
| 2 | mp2 | lv2 | ph2 | ps2 |
| 3 | mp3 | lv3 | ph3 | ps3 |
| ⋮ | ⋮ | ⋮ | ⋮ | ⋮ |

FIG. 9

FUNDAMENTAL AEG-vs.-KEY TABLE

| Key No. | attack time | decay time | decay level | sustain time | release time |
|---|---|---|---|---|---|
| 1 | at1 | dt1 | dl1 | st1 | rt1 |
| 2 | at2 | dt2 | dl2 | st2 | rt2 |
| 3 | at3 | dt3 | dl3 | st3 | rt3 |
| ⋮ | ⋮ | ⋮ | ⋮ | ⋮ | ⋮ |

FIG. 10

ACOUSTIC EFFECT IMPARTMENT APPARATUS, AND PIANO

BACKGROUND

The present invention relates to techniques for changing or controlling a sound (i.e., musical sound or tone) of an acoustic piano.

In the field of acoustic pianos, there have been developed control techniques for changing a sound generated by a keyboard performance on the piano. One example of such control techniques additionally uses an electronic sound generator that outputs an electronic audio signal, such as that of a desired musical instrument sound, in accordance with behavior of a key. In such a case, an electric sound etc. are generated from the electronic sound generator together with an acoustic sound generated from the acoustic piano, or without such an acoustic sound (i.e., with the acoustic piano kept in a silent state). However, with the control technique where an electric sound generated from the electronic sound generator is directly inserted as noted above, a natural feeling of sound generation by the acoustic piano sometimes cannot be reproduced, so that it has heretofore been desired to impart an acoustic piano sound with an acoustic effect having a natural feeling.

Japanese Patent Application Laid-open Publication No. HEI 05-73039 (hereinafter referred to as "the relevant patent literature") discloses a technique which, for imparting an acoustic effect having a natural feeling while maintaining a natural acoustic piano sound, extracts, as a string vibration signal, vibration of a string in real time when the acoustic piano is generating a sound through the vibration of the string, then generates a soundboard driving signal by performing arithmetic operations for imparting a desired acoustic effect to the extracted string vibration signal and then actively vibrates the soundboard with the generated soundboard driving signal. With the technique disclosed in the relevant patent literature, the soundboard driven with the soundboard driving signal vibrates, in response to the soundboard driving signal, just like a speaker cone and can thereby impart an acoustic effect having a natural feeling. However, because the vibration signal to be used for driving the soundboard is merely a signal obtained by picking up the vibration of the string of the acoustic piano as-is, it comprises various frequency components, and thus, the technique disclosed in the relevant patent literature cannot perform free control, like control for driving the soundboard while emphasizing a particular harmonic component, so that it can achieve only poor control performance or controllability.

Also note that, in the aforementioned type of soundboard driving construction, vibration of the soundboard produced by the soundboard driving signal containing various frequency components is fed back to the string being vibrated by striking with a hammer. With the technique disclosed in the relevant patent literature, where such feedback vibration to the string contains various and complicated frequency components, an unintended sound generation state may sometimes result due to synthesis between the original string vibration and the feedback vibration depending on relationship between the original string vibration and the feedback vibration. As a consequence, a resultant piano sound having been imparted with an acoustic effect may sometimes end up having a reduced natural feeling of the acoustic piano despite a user's intention.

SUMMARY OF THE INVENTION

In view of the foregoing prior art problems, the present invention seeks to impart a sound of an acoustic piano with an acoustic effect without impairing a natural feeling of an acoustic piano sound.

In order to accomplish the above-mentioned object, the present invention provides an improved acoustic effect impartment apparatus for use in a piano including a plurality of keys, a plurality of strings provided in corresponding relation to the keys and a plurality of hammers each responsive to an operation of any one of the keys to strike the string corresponding to the key, the acoustic effect impartment apparatus comprising: a detection section (120) configured to detect striking of any one of the strings by a corresponding one of the hammers; a signal generation section (130) configured to generate, on the basis of a detection result of the detection section, at least one sine wave signal having a frequency based on a fundamental frequency of the string struck by the hammer; a vibration section (50) configured to generate vibration corresponding to the at least one sine wave signal generated by the signal generation section; and a vibration transmission structure (6, 7) configured to transmit the vibration, generated by the vibration section, to the strings (5). Note that the same reference characters as used for various constituent elements of later-described embodiments of the present invention are indicated in parentheses here for ease of understanding. As well known in the art, a combination of a plurality of strings (or at least one string) is provided in association with each key. In this disclosure, the string corresponding to one key actually comprises such a combination of one or a plurality of strings. Namely, in this disclosure, a combination of one or a plurality of strings provided in association with each key will be referred to as simply as "string" for convenience of description.

In response to striking of any one of the strings by the corresponding hammer, at least one sine wave signal having a frequency based on the fundamental frequency of the hammer-struck string, and mechanical vibration corresponding to the sine wave signal is generated and transmitted to the keys via the vibration transmission structure (6, 7). Such arrangements create a state where a sound based on the vibration of the hammer-struck string has been imparted with an acoustic effect based in indirect vibration corresponding to the sine wave signal in addition to a direct vibration sound based on the vibration of the hammer-struck string. Because a waveform of a sound generator for imparting the acoustic effect is a simple waveform of the sine wave signal and does not contain superfluous frequency components like those found in sampled sounds of a piano. Therefore, even where indirect feedback vibration corresponding to the sine wave signal has been transmitted to the string, a natural feeling of the acoustic piano will not be lost. In addition, the present invention can readily perform free control of, for example, transmitting to the string indirect feedback vibration with a particular harmonic component emphasized, thereby achieving superior control performance or controllability.

In an embodiment, the signal generation section further generates a sine wave signal having a harmonic frequency that is inharmonic to the fundamental frequency of the string struck by the hammer. Preferably, the sine wave signal having the harmonic frequency inharmonic to the fundamental frequency has a frequency greater by a value, predetermined depending on a note of the struck string, than a frequency that is m (m is an integral number of two or more) times higher than the fundamental frequency of the string struck by the hammer.

In an embodiment, the acoustic effect impartment apparatus of the present invention further comprises a setting section configure to set, in association with the string of each of the keys, an amplitude adjustment value for adjusting an amplitude of the at least one sine wave signal, and the vibration section generates, with the amplitude adjusted in accordance with the amplitude adjustment value, the vibration corresponding to the at least one sine wave signal. Thus, a waveform of the vibration transmitted (fed back) to the hammer-struck string can be adjusted in amplitude for each of the strings (i.e., for each of the keys), so that the present invention can appropriately control the acoustic effect impartment for each hammer-struck string.

In an embodiment, the setting section sets the amplitude adjustment value in response to a user's operation. In an embodiment, the setting section sets the amplitude adjustment values corresponding to the individual strings in accordance with a frequency characteristic of vibration transmission from the signal generation section to the strings via the vibration section and the vibration transmission structure. In an embodiment, the setting section sets the amplitude adjustment values corresponding to the individual strings with an inverse characteristic of the frequency characteristic of vibration transmission.

Further, in an embodiment, the acoustic effect impartment apparatus further comprises: a storage section storing setting information that defines a character of the at least one sine wave signal; and a setting section configure to set the character defined by the setting information stored in the storage section, and the signal generation section generates the at least one sine wave signal having the character defined by the setting information in association with the string struck by the hammer. Thus, the present invention can define, using the setting information stored in the storage section, a feature of the sine wave signal to be used for impartment of an acoustic effect, thereby achieving good usability.

According to another aspect of the present invention, there is provided an acoustic effect impartment apparatus for use in a piano including a plurality of keys, a plurality of strings provided in corresponding relation to the keys and a plurality of hammers each responsive to an operation of any one of the keys to strike the string corresponding to the key, the acoustic effect impartment apparatus comprising: a detection section (120) configured to detect striking of any one of the strings by a corresponding one of the hammers; a signal generation section (130) configured to generate, on the basis of a detection result of the detection section, at least one driving waveform signal based on a fundamental frequency of the string struck by the hammer; a setting section (200, 200A, 200B) configure to set, in association with the string of each of the keys, an amplitude adjustment value for adjusting an amplitude of the at least one driving waveform wave signal; a vibration section (50) configured to generate vibration corresponding to the at least one driving waveform signal adjusted in amplitude with the amplitude adjustment value; and a vibration transmission structure (6, 7) configured to transmit the vibration, generated by the vibration section, to the strings (5). Thus, a waveform of the vibration transmitted (fed back) to the hammer-struck string can be adjusted in amplitude for each of the strings (i.e., for each of the keys), so that the present invention can appropriately control the acoustic effect impartment for each hammer-struck string.

The following will describe embodiments of the present invention, but it should be appreciated that the present invention is not limited to the described embodiments and various modifications of the invention are possible without departing from the basic principles. The scope of the present invention is therefore to be determined solely by the appended claims.

BRIEF DESCRIPTION OF THE DRAWINGS

Certain preferred embodiments of the present invention will hereinafter be described in detail, by way of example only, with reference to the accompanying drawings, in which:

FIG. 9 is a diagram explanatory of contents of a fundamental tone OSC-vs.-key table in the embodiment of the present invention;

FIG. 10 is a diagram explanatory of contents of a fundamental tone AEG-vs.-key table in the embodiment of the present invention;

DETAILED DESCRIPTION

Overall Construction

Figure 1:
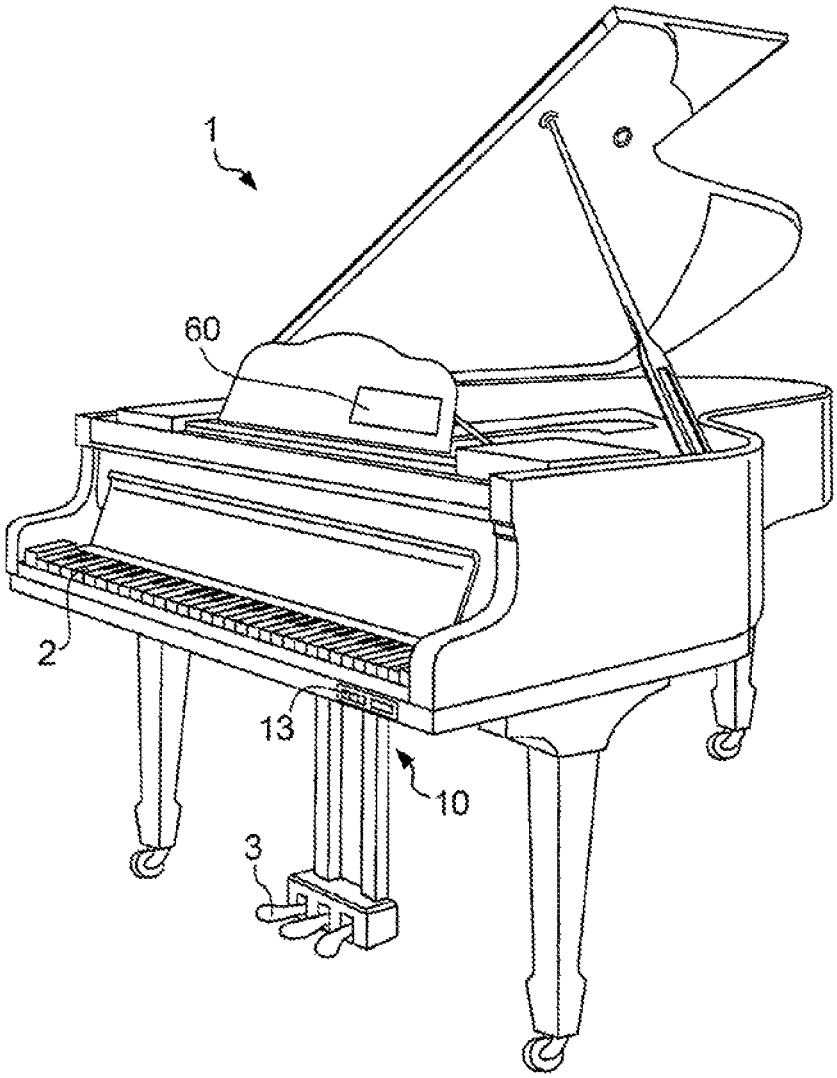
FIG. 1 is a perspective view showing an outer appearance of a grand piano employing a preferred embodiment of an acoustic effect impartment apparatus of the present invention.

FIG. 1 is a perspective view showing an outer appearance of a grand piano 1 employing a preferred embodiment of an acoustic effect impartment apparatus of the present invention. The grand piano 1 includes a keyboard provided on a front side (i.e., a side closer to a human player or user playing the piano 1) of the piano 1 and having a plurality of keys 2 operable by the human player or user for a music performance, and pedals 3. The grand piano 1 also includes a tone generator device 10 having an operation panel 13 on its front surface portion, and a touch panel 60 provided on a portion of a music stand. User's instructions can be input to the tone generator device 10 by the user operating the operation panel 13 and touch panel 60.

The grand piano 1 is capable of generating a sound in any one of a plurality of sound generation modes that corresponds to a user's instruction. As in the conventionally-known grand pianos, the plurality of sound generation modes include: an ordinary sound generation mode for generating a sound only in response to striking of a string by a hammer; an acoustic effect imparting mode for generate a sound with an acoustic effect imparted thereto in a manner implemented by the acoustic effect impartment apparatus of the present invention; and a silencing sound generation mode for generating a sound via the electronic sound generator while effecting silence by preventing striking of a string with a hammer, i.e. by preventing mechanical-vibration-based sound generation. In the acoustic effect imparting mode, it is possible to determine an acoustic effect to be imparted and then store the thus-determined content into a memory. Note that the ordinary sound generation mode and the silencing sound generation mode are not essential to practicing the present invention. Note that either one of the aforementioned performance modes may be dispensed with in the instant embodiment.

Further, the grand piano 1 is capable of operating in any one of a plurality of performance modes that corresponds to a user's instruction. The plurality of performance modes include an ordinary performance mode for generating a sound in response to a user's performance operation, and an automatic performance mode for automatically driving a key to generate a sound corresponding to the automatically-driven key.

[Construction of the Grand Piano 1]

Figure 2:
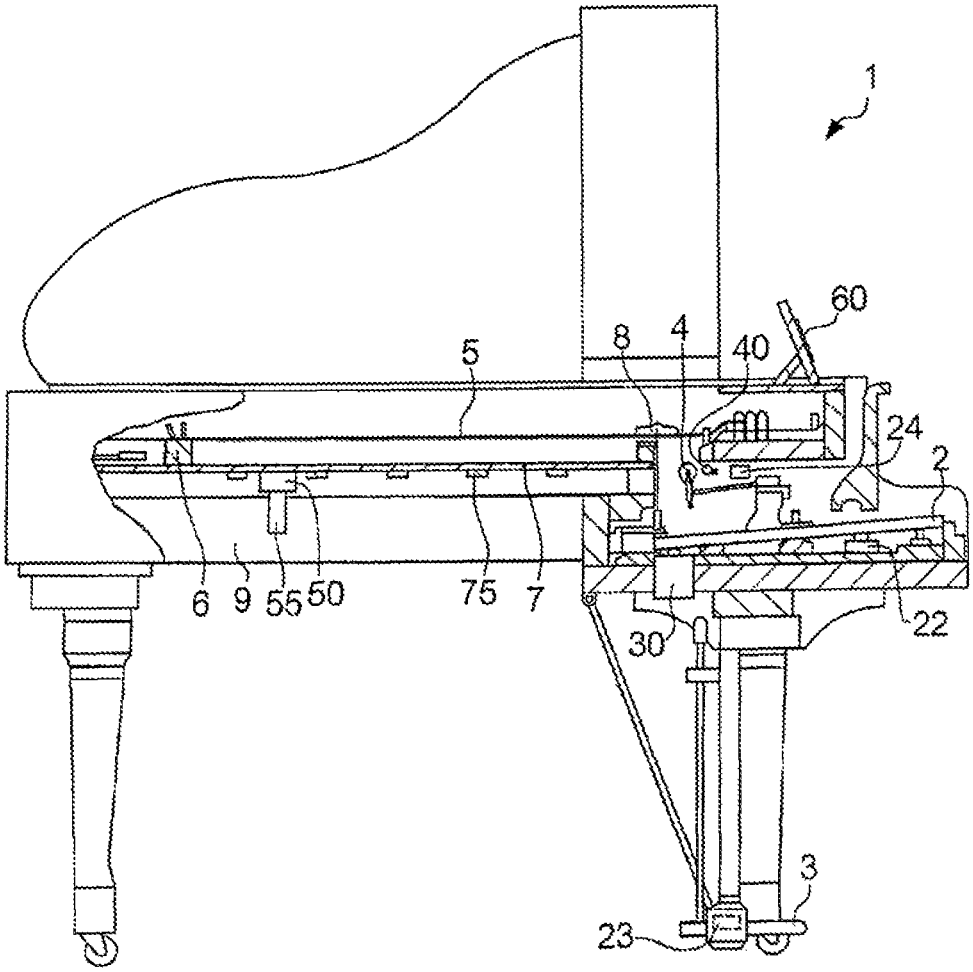
FIG. 2 is a view explanatory of an internal construction of the grand piano.

FIG. 2 is a view explanatory of an internal construction of the embodiment of the grand piano 1. In FIG. 2, an inner construction corresponding to only one key 2 is shown with an inner construction corresponding to the other keys 2 omitted for simplicity of illustration.

Underneath a back end portion (i.e., end portion remote from the user of the grand piano 1) of each of the keys 2 is provided a key drive section 30 for driving the key 2 by use of a solenoid. The key drive section 30 drives the solenoid in accordance with a control signal given from the tone generator device 10. More specifically, the key drive section 30 drives the solenoid to raise a plunger so as to reproduce a similar state to when the user has depressed the key 2, and lowers the plunger to reproduce a similar state to when the user has released the key 2. Namely, a difference between the ordinary performance mode and the automatic performance mode is whether the key 2 is driven by a user's operation or by the key drive section 30.

Hammers 4 are provided in corresponding relation to the keys 2. Thus, once any one of the keys 2 is depressed by the user, depressing force is transmitted to the corresponding hammer 4 via an action mechanism (not shown), so that the hammer 4 moves to strike the corresponding string 5. A damper 8 is brought out of or into contact with the string 5 in accordance with a depressed amount of the key 2 and a pressed-down amount of a damper pedal of the pedals 3; hereinafter, the "pedal 3" will refer to the damper peal unless otherwise stated. When in contact with the string 5, the damper 8 suppresses vibration of the string 5.

Generally, in the acoustic grand piano, as well known in the art, a combination of a plurality of strings (or at least one string) is provided in association with each key. In this disclosure, the string 5 corresponding to one key 2 actually comprises such a combination of one or a plurality of strings. Namely, in this disclosure, a combination of one or a plurality of strings provided in association with each key will be referred to as simply as "string 5" for convenience of description In the above-mentioned silencing sound generation mode, a stopper 40 prevents the hammer 4 from striking the string 5. Namely, when the sound generation mode is set in the silencing sound generation mode, a hammer shank collides against the stopper 40 so that the hammer 4 is prevented from striking the string 5, while the sound generation mode is set in other than the silencing sound generation mode, on the other hand, the stopper 40 moves to a position where it does not collide against the hammer shank. Namely, in accordance with a control signal given from the sound generator device 10, the stopper 40 moves to a position where it prevents the hammer 4 from striking the string 5 or to a position where it does not prevent the hammer 4 from striking the string 5.

Key sensors 22 are provided in corresponding relation to the keys 2 and underneath the corresponding keys 2, and each of the key sensors 22 detects a depressed amount of the corresponding key 2 and outputs, to the sound generator device 10, a detection signal indicative of the detected depressed amount (detected result). Instead of outputting the detected depressed amount of the key 2 as a detection signal, the key sensor 22 may output a detection signal indicating that the key 2 has passed a particular depressed position. Here, the particular depressed position refers to any suitable position, preferably a plurality of positions, within a range from a rest position to an end position of the key 2. Namely, the detection signal to be output from the key sensor 22 may be any kind of signal as long as it allows the sound generator device 10 to recognize behavior of the corresponding key 2.

Hammer sensors 24 are provided in corresponding relation to the hammers 4, and each of the hammer sensors 24 outputs, to the sound generator device 10, a detection signal representing behavior of the corresponding hammer 4. In the illustrated example, the hammer sensor 24 detects a moving speed of the hammer 4 immediately before striking the string 5, and outputs, to the sound generator device 10, a detection signal indicative of the detected moving speed (detected result). Note that this detection signal need not necessarily be indicative of the moving speed of the hammer 4 itself and may be indicative of a moving speed of the hammer 4 calculated in the sound generator device 10 as another form of detection signal. For example, the detection signal may be one indicating that the hammer shank has passed two predetermined positions during movement of the hammer 4, or one indicative of a time length from a time point at which the hammer shank has passed one of the two positions to a time point at which the hammer shank has passed the other of the two positions. Namely, the detection signal to be output from the hammer sensor 24 may be any kind of signal as long as it allows the sound generator device 10 to recognize behavior of the corresponding hammer 4.

Pedal sensors 23 are provided in corresponding relation to the pedals 3, and each of the pedal sensors 23 outputs, to the sound generator device 10, a detection signal representing behavior of the corresponding hammer 3. In the illustrated example, the pedal sensor 23 detects a pressed-down amount of the pedal 3 and outputs, to the sound generator device 10, a detection signal indicative of the detected pressed-down amount (detected result of the pedal 3). Alternatively, the pedal sensor 23 may output a detection signal indicating that the pedal 3 has passed a particular press-down position, instead of outputting a detection signal corresponding to a pressed-down amount of the pedal 3. Here, the "particular press-down position" is any suitable position within a range from a rest position to an end position of the pedal 3, and the particular press-down position is desirably set at a position to permit discrimination between the contacting state where the damper 8 and the string 5 are in complete contact with each other and the non-contacting state where the damper 8 and the string 5 are out of contact with each other. It is further desirable that a plurality of such particular press-down positions be set so as to permit detection of a half-pedal state as well. Namely, the detection signal to be output from the pedal sensor 23 may be any kind of signal as long as it allows the sound generator device 10 to recognize behavior of the pedal 3.

As long as the sound generator device 10 is constructed in such a manner that, with the detection signals output from the key sensors 22, pedal sensors 23 and hammer sensors 24, it can identify, for each individual key (key number) 2, a time point (string-striking time point) at which the hammer 4 has struck the string 5 (i.e., key-on event time), striking velocity and a time point (vibration-suppressing time point) at which the damper 8 has suppressed vibration of the string (key-off event time point), then each of the key sensors 22, pedal sensors 23 and hammer sensors 24 may output detected results of behavior of the key 2, pedal 3 and hammer 4 as other forms of detection signals than the aforementioned.

As conventionally known in the art, a soundboard 7 of the piano is backed with a plurality of bracing members 75, and a bridge 6 spanning between the strings 5 are fixed to the surface of the soundboard 7. As also conventionally known, as any one of the strings 5 is struck by the corresponding hammer 4 in response to depression of the key 2, the string 5 vibrates, so that the vibration of the string 5 is transmitted to the soundboard 7 via the bridge 6. Such vibration of the string 5 and soundboard 7 resonates within a casing of the piano 1, thereby generating an audible sound.

At least one vibration section 50 is provided on a suitable portion of the soundboard 7; for example, the vibration section 50 may be provided on the surface (reverse face) of the soundboard 7 opposite from the surface (front face) on which the strings 5 are provided in a stretched-taut fashion. The vibration section 50 includes an actuator for transmitting vibration to the soundboard 7, and a drive circuit for mechanically driving the actuator in accordance with an electric signal. The drive circuit amplifies an electric/electronic driving waveform signal, output from the sound generator device 10, to supply the thus-amplified driving waveform signal to the actuator, so that the actuator is vibrated by the drive circuit in accordance with the waveform represented by the driving waveform signal. Further, the vibration section 50 is fixedly supported by a support section 55 connected to a straight strut 9 of a framework of the piano, and the vibration section 50 is also connected to, or held in contact with, the soundboard 7 so as to transmit vibration to the soundboard 7. Note that the vibration section 50 may be fixedly supported directly by the soundboard 7, not via the support section 55. In such a case, the vibration section 50 transmits vibration, corresponding to the driving waveform signal, to the soundboard 7 by inertia force.

Figure 3:
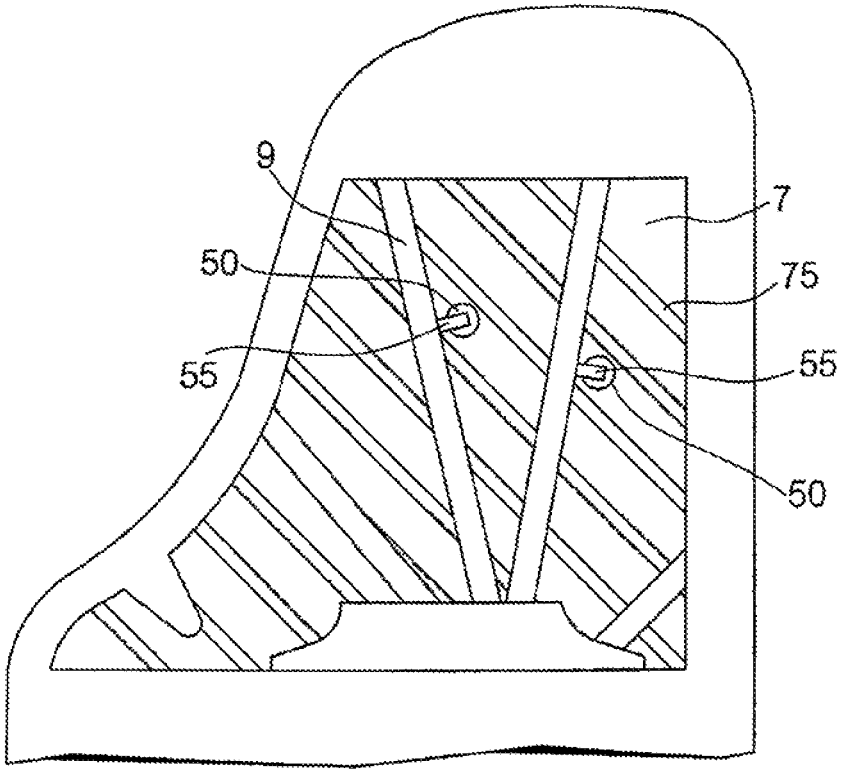
FIG. 3 is a view explanatory of a mounted position of a vibration section in the embodiment of the present invention.

FIG. 3 is a view explanatory of a mounted position of the vibration section 50 in the instant embodiment of the invention. As shown in FIG. 3, the vibration section 50 is connected to the soundboard 7 between the bracing members 75. Note that, whereas a plurality of the vibration sections 50 are provided on the soundboard 7 in the illustrated example, only one vibration section 50 may be provided on the soundboard 7. Further, the vibration section 50 may be connected to, or held in contact with, the bracing members 75. Further, the vibration section 50 may be provided on a portion of the soundboard 7 that positionally corresponds to the bridge 6 (i.e., on the reverse face of the soundboard 7 opposite from the surface of the soundboard 7 where the bridge 6 is provided). In this case, the soundboard 7 is sandwiched, in a thickness direction thereof, between the vibration section 50 and the bridge 6. The soundboard 7 and the bridge 6 function as a vibration transmission mechanism for transmitting mechanical vibration, generated by the vibration section 50, to the strings 5.

[Construction of the Sound Generator Device 10]

Figure 4:
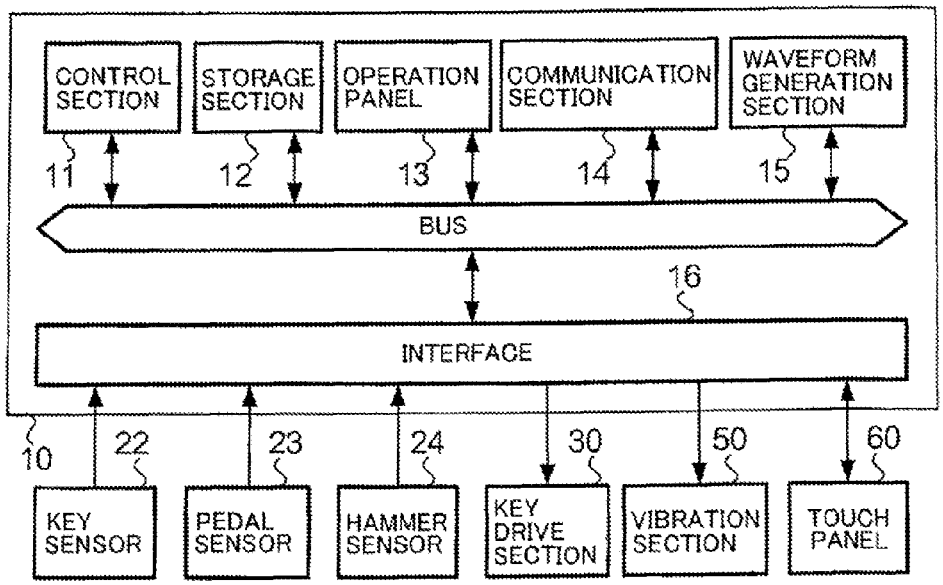
FIG. 4 is a block diagram showing a construction of a sound generator device in the embodiment of the present invention.

FIG. 4 is a block diagram showing a construction of the sound generator device 10 in the instant embodiment of the invention. The sound generator device 10 includes a control section 11, a storage section 12, an operation panel 13, a communication section 14, a waveform generation section 15 and an interface 16, and these components are interconnected via a bus.

The control section 11 includes an arithmetic operation unit, such as a CPU (Central Processing Unit), and a storage device including a ROM (Read-Only Memory), a RAM (Random Access Memory), etc. The control section 11 controls the various components of the sound generator device 10 and various components connected to the interface 16 on the basis of a control program stored in the storage device. In the illustrated example, the control section 11 causes the sound generator device 10 and some of the components connected to the sound generator device 10 to function as the acoustic effect impartment apparatus 100 (see FIG. 5), by executing the control program.

The storage section 12 stores therein setting information indicative of various settings for use during execution of the control program. The setting information is information for determining, on the basis of detection signals output from the key sensor 22, pedal sensor 23 and hammer sensor 24, content of the driving waveform signal to be generated by the waveform generation section 15. For example, a table defining relationship between depressed keys 2 and driving waveform signals to be generated is contained in the setting information. The storage section 12 stores therein a plurality of setting information of different contents as will be later described in detail.

The operation panel 13 includes, among other things, operation buttons operable by the user, i.e. capable of receiving user's operations. Once a user's operation is received via any one of the operation buttons on the operation panel 13, an operation signal corresponding to the user's operation is output to the control section 11. A touch panel 60 connected to the interface 16 includes a display screen, such as a liquid crystal display, and touch sensors for receiving user's operations are provided on a display section of the display screen. On the display screen are displayed, under control of the control section 11 via the above-mentioned interface 16, a selection screen for selecting one (more specifically one set) of setting information from among a plurality of sets of setting information stored in the storage section 12, a setting screen for setting any one of various modes and the like, and various information, such as a musical score. The touch panel 60 provides an operation screen of a user interface for receiving a user's input. Examples of the operation screens (setting screens) will be detailed later with reference to FIGS. 13A and 13B. Once a user's operation is received via the touch sensor, an operation signal corresponding to the user's operation is output to the control section 11 via the interface 16. User's instructions to the sound generator device 10 are input through user's operations received via operations devices, including the operation panel 13, touch panel 60 etc., and user interface associated with the operations devices.

The communication section 14 is an interface for performing communication with other devices in a wired and/or wireless fashion. To this interface may be connected a disk drive that reads out various data recorded on a storage medium, such as a DVD (Digital Versatile Disk) or CD (Compact Disk). Examples of data input to the sound generator device 10 via the communication section 14 include music piece data for use in an automatic performance.

The waveform generation section 15 includes a sound generator which, under control of the control section 11, generates a sine wave signal and outputs the sine wave signal after envelope adjustment of the sine wave signal.

The interface 16 is an interface that interconnects the sound generator device 10 and individual external components. Examples of the components connected to the interface 16 include the key sensor 22, pedal sensor 23, hammer sensor 24, key drive section 30, stopper 40, vibration section 50 and touch panel 60. The interface 16 supplies the control section 11 with detection signals output from the key sensor 22, pedal sensor 23 and hammer sensor 24 and operation signals output from the touch panel 60. Further, the interface 16 supplies the key drive section 30 and stopper 40 with a control signal output from the control section 11, and it supplies the vibration section 50 with a driving waveform signal output from the waveform generation section 15.

The following describe the acoustic effect impartment apparatus 100 whose functions are implemented by the control section 11 executing the control program. The control program is a program executed when the sound generation mode is the above-mentioned acoustic effect imparting mode.

[Functional Construction of the Acoustic Effect Impartment apparatus 100]

Figure 5:
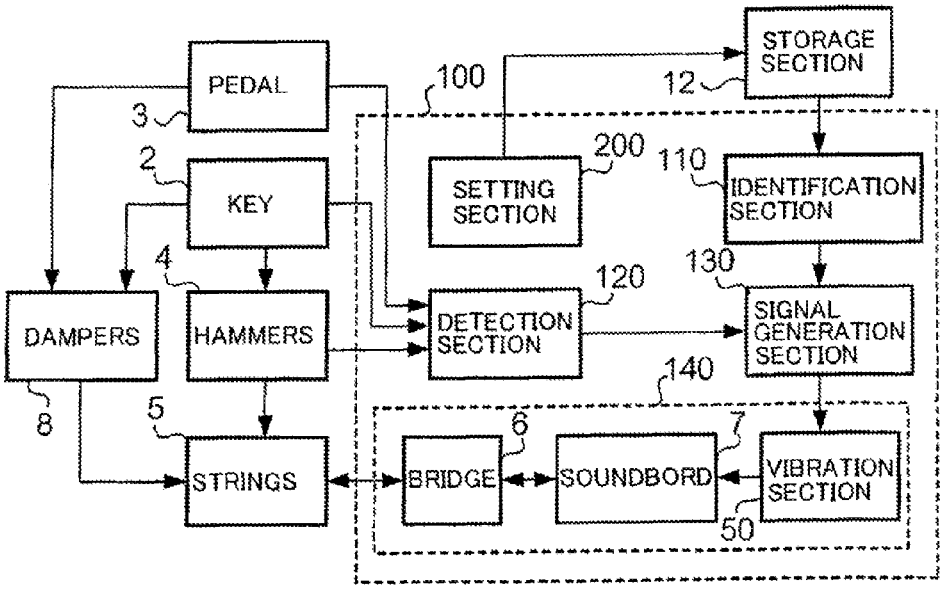
FIG. 5 is a block diagram showing a functional construction of the embodiment of the acoustic effect impartment apparatus of the present invention.

FIG. 5 is a block diagram showing a functional construction of the acoustic effect impartment apparatus 100 according to the preferred embodiment of the present invention. The acoustic effect impartment apparatus 100 includes an identification section 110, a detection section 120, a signal generation section 130, a signal transmission section 140 and a setting section 200. As shown in FIG. 5, as the key 2 is operated by the user, the hammer 4 strikes the string 5 so that the string 5 vibrates. Also, the damper 8 operates in response to the user's operation of the key 2 and pedal 3. By the operation of the damper 8, a vibration suppression state of the string 5 is changed.

The identification section 110 receives, via the touch panel 60, a user's operation for selecting a set of setting information from among the plurality of sets of setting information stored in the storage section 12. Further, the identification section 110 identifies, by means of the control section 11, the selected set of setting information as setting information for use in the signal generation section 130 and then retrieves the identified (selected) set of setting information from the storage section 12.

The detection section 120 detects respective behavior of the key 2, pedal 3 and hammer 4 via the key sensor 22, pedal sensor 23 and hammer sensor 24. Also, on the basis of detection signals output from the key sensor 22, pedal sensor 23 and hammer sensor 24, the detection section 120 identifies, by means of the control section 11, a string striking time point at which the hammer 4 has struck the string 5 (i.e., key-on event time point), the key number of the key 2 corresponding to the struck string 5, string striking velocity and a vibration suppression time when the damper 8 has suppressed vibration of the string 5 (i.e., key-off timing), as information (sound control information) for use in the signal generation section 130. In the illustrated example, the detection section 120 identifies the string striking time point and key number of the key 2 from behavior of the key 2, identifies the string striking velocity from the behavior of the hammer 4, and identifies the vibration suppression time from behavior of the key 2 and pedal 3. Alternatively, the string striking time point may be identified from the behavior of the hammer 4, and the string striking velocity may be identified from the behavior of the key 2.

The detection section 120 outputs tone control information, indicative of the key number, velocity and key-on event, to the signal generation section 130 at the identified key-on timing. Also, the detection section 120 outputs tone control information, indicative of the key number and key-off event, to the signal generation section 130 at the identified key-off timing.

The signal generation section 130 generates, by means of the waveform generation section 15, a sine wave signal on the basis of the tone control information output from the detection section 120 and then outputs to the signal transmission section 140 the thus-generated sine wave signal as a driving waveform signal. Here, a manner in which the sine wave signal is to be generated by the signal generation section 130 is instructed by the control section 11 on the basis of the setting information identified by the identification section 110. A detailed functional construction of the signal generation section 130 will be discussed later.

The signal transmission section 140 transmits the driving waveform signal from the signal generation section 130 to each of the strings 5. Namely, the signal transmission section 140 supplies the driving waveform signal to the vibration section 50 to vibrate the actuator and transmits vibration, indicated by the driving waveform signal, to each of the strings 5 via the soundboard 7 and bridge 6. As conventionally known in the art, vibration of the string 5 excited by the hammer 4 striking the string 5 is also transmitted to the bridge 6 and soundboard 7.

[Functional construction of the Signal Generation Section 130]

The following discuss the detailed functional construction of the signal generation section 130.

Figures 6, 7:
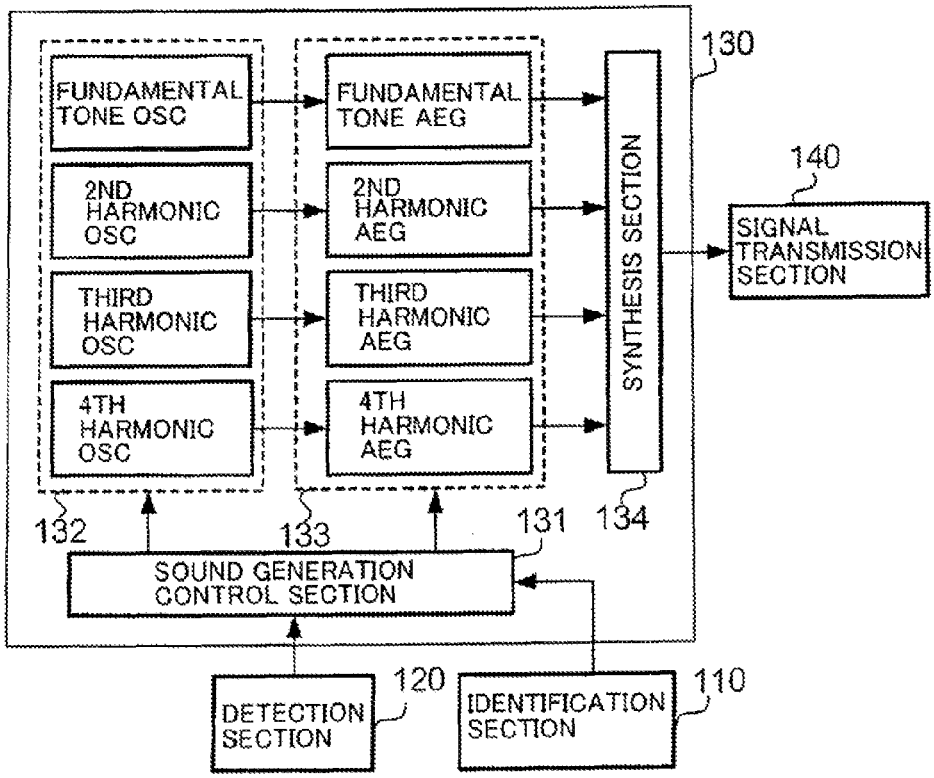
FIG. 6 is a block diagram showing a functional construction of a signal generation section in the embodiment of the present invention.
FIG. 7 is a diagram explanatory of contents of a fundamental characteristic-vs.-key table in the embodiment of the present invention.

FIG. 6 is a block diagram showing the detailed functional construction of the signal generation section 130 provided in the instant embodiment. The signal generation section 130 includes a sound generation control section 131 implemented by the control section 11, a sine wave generation section 132 implemented by the waveform generation section 15, an envelope adjustment section 133 and a synthesis section 134. In the illustrated example, the sine wave generation section 132 includes a fundamental tone OSC (oscillator), a second harmonic OSC, a third harmonic OSC and a fourth harmonic OSC. The fundamental tone OSC, second harmonic OSC, third harmonic OSC and fourth harmonic OSC each generate a sine wave signal under control of the sound generation control section 131.

The envelope adjustment section 133 includes a fundamental tone AEG (Amplitude Envelope Generator), a second harmonic AEG a third harmonic AEG and a fourth harmonic AEG that are provided in corresponding relation to the fundamental tone OSC, second harmonic OSC, third harmonic OSC and fourth harmonic OSC, and each of the fundamental tone AEG, second harmonic AEG, third harmonic AEG and fourth harmonic AEG adjusts variation over time of the amplitude of the input sine wave signal under control of the sound generation control section 131 and outputs the thus-adjusted result.

The synthesis section 134 synthesizes (adds together) the sine wave signals output from the envelope adjustment section 133 and outputs the synthesized result to the signal transmission section 140 as the driving waveform signal.

The sound generation control section 131 controls behavior of the sine wave generation section 132 and envelope adjustment section 133 on the basis of the setting information identified by the identification section 110 and the tone control information output by the detection section 120. Namely, the sine wave signals output from the envelope adjustment section 133 are controlled in frequency, amplitude, etc. by the sound generation control section 131.

The following explain contents of each set of the setting information (i.e., setting information set). In the illustrated example, each of the setting information sets contains a plurality of tables that include: a fundamental characteristic-vs.-key table defining relationship between key numbers and control parameters of the entire sine wave generation section 132; a fundamental tone OSC-vs.-key table defining relationship between key numbers and control parameters of the fundamental tone OSC; and a fundamental tone AEG-vs.-key table defining relationship between key numbers and control parameters of the fundamental tone AEG. The setting information set also contains a second harmonic OSC-vs.-key table, third harmonic OSC-vs.-key table and fourth harmonic OSC-vs.-key table defining, similarly to the fundamental tone OSC-vs.-key table, relationship between control parameters of the second harmonic OSC, third harmonic OSC and fourth harmonic OSC and key numbers, as well as a second harmonic AEG-vs.-key table, third harmonic OSC-vs.-key table and fourth harmonic OSC-vs.-key table defining, similarly to the fundamental tone AEG-vs.-key table, relationship between control parameters of the second harmonic AEG, third harmonic AEG and fourth harmonic AEG and key numbers. Namely, the setting information defines, in each of the tables, characters of the sine wave signal contained in the driving waveform signal.

Note that description of the second harmonic OSC-vs.-key table, third harmonic OSC-vs.-key table and fourth harmonic OSC-vs.-key table will be omitted here because they are different from the fundamental tone OSC-vs.-key table only in targets which they are applied to. Similarly, the second harmonic AEG-vs.-key table, third harmonic AEG-vs.-key table and fourth harmonic AEG-vs.-key table will be omitted here because they are different from the fundamental tone AEG-vs.-key table only in targets which they are applied to.

The setting information set also includes a plurality of types of information (i.e., velocity curves) each defining relationship between velocities and amplitude levels. Alternatively, however, such information (velocity curves) may be provided separately from the setting information. The setting information set may also include information containing parameters for controlling a degree of effectiveness of the damper pedal 3, such as a half-pedal effect, in accordance with a pressed-down amount of the damper pedal 3.

Figure 8A:
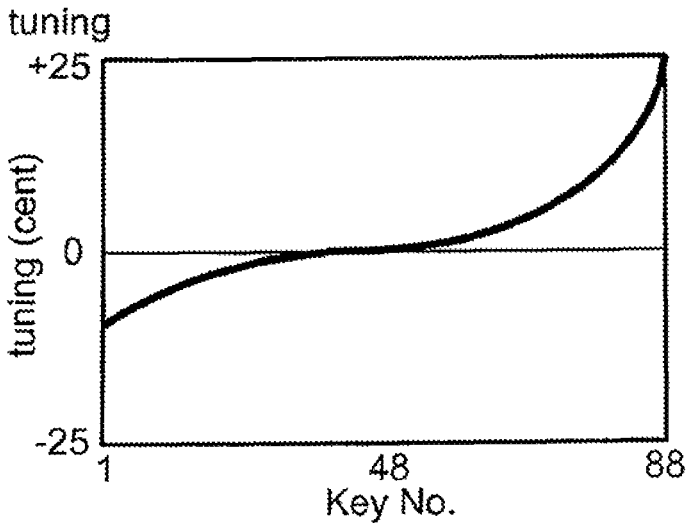
FIGS. 8A and 8B are diagrams explanatory of specific examples of the fundamental characteristic-vs.-key table in the embodiment of the present invention.
Figure 8B:
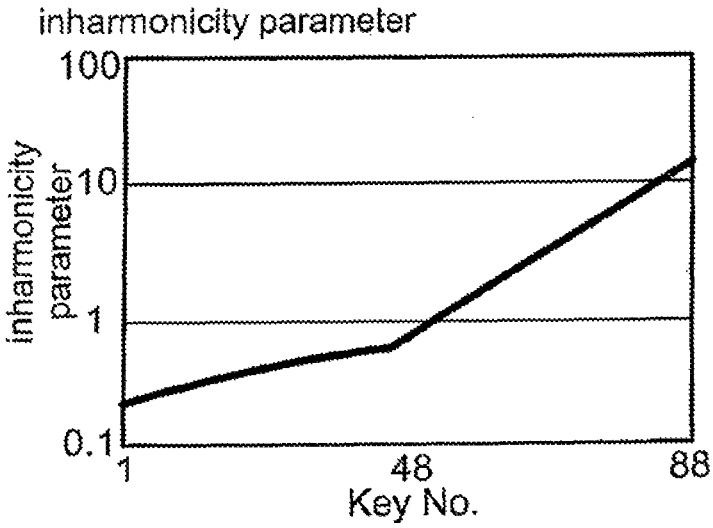

FIG. 7 is a diagram explanatory of contents of the fundamental characteristic-vs.-key table employed in the instant embodiment. The fundamental characteristic-vs.-key table is a table which, for each key number, defines parameters of fundamental tone pitch tuning, master volume, inharmonicity and velocity adjustment. FIGS. 8A and 8B are diagrams explanatory of specific examples of the fundamental tone pitch tuning and inharmonicity of the fundamental characteristic-vs.-key table in the instant embodiment. As conventionally known in the art, the key numbers correspond to notes.

The parameter of the fundamental tone pitch tuning (fundamental tone pitch tuning parameter) is a parameter (tn1, tn2, . . . ) for tuning fundamental frequencies of keys 2 corresponding to individual key numbers, i.e. for determining a fundamental frequency of a sine wave signal to be generated by the fundamental tone OSC. In the illustrated example, the fundamental tone pitch tuning parameters are each indicative, in cents, of a deviation amount from an equal temperament, and they are predetermined in accordance with relationship as shown in FIG. 8A. The relationship shown in FIG. 8A represents one of a plurality of sets of setting information of the fundamental tone pitch tuning stored in the storage section 12. Namely, a plurality of sets of setting information (setting information sets) related to a plurality of types of tuning, such as the equal temperament and just or pure intonation, can be stored in the storage section 12, and the user can select any one of the prestored types of tuning. Note that the parameters of the fundamental tone pitch tuning may be indicative of frequency deviation amounts in cents, or may be defined by pitch frequencies themselves.

The parameter of the inharmonicity (inharmonicity parameter) is a parameter (ih1, ih2, . . . ) indicative of a degree of inharmonicity of an acoustic piano such that a frequency of an m (m is an integral number equal to or greater than two)-th harmonic becomes slightly greater than an accurate m times of the fundamental frequency. Such an inharmonicity parameter determines, for each of fundamental frequencies corresponding to key numbers, degrees of inharmonicity of sine wave signals to be generated by the second, third and fourth harmonic OSCs. Although the inharmonicity parameter may be defined in any desired manner, let it be assumed that the inharmonicity parameters in the illustrated example correspond to "parameter b values" disclosed in Japanese Patent Application Laid-open Publication No. HEI-4-191894 and are defined in accordance with relationship as shown in FIG. 8B. The relationship shown in FIG. 8B represents one of a plurality sets of setting information of the inharmonicity stored in the storage section 12. In this manner, a frequency of an m (m is an integral number equal to or greater than two)-th harmonic having an inharmonic characteristic relative to the fundamental frequency is defined for each key number.

The parameter of the master volume (master volume parameter) is a parameter (vm1, vm2, . . . ) for controlling the amplitude of a sine wave signal to be generated by the sine wave generation section 132, and such a master volume parameter is defined for each key number. The parameter of the velocity (velocity parameter) is a parameter (va1, va2, . . . ) indicative of a velocity curve to be applied, and such a velocity parameter is defined for each key number.

FIG. 9 is a diagram explanatory of contents of the fundamental tone OSC-vs.-key table in the instant embodiment. The fundamental tone OSC-vs.-key table defines, for each key number, parameters of a multiple, slave volume (level), phase and pitch (pitch adjustment).

The "multiple" parameter is a parameter (mp1, mp2, . . . ) defining, for each key number, relationship between a frequency of a sine wave signal to be generated by the fundamental tone OSC and the fundamental tone pitch. Normally, the multiple is defined, for all key numbers, as "one time" in the fundamental tone OSC-vs.-key table, "two times" in the second harmonic OSC-vs.-key table, "three times" in the third harmonic OSC-vs.-key table, and "four times" in the fourth harmonic OSC-vs.-key table.

The parameter of the slave volume (slave volume parameter) is a parameter (lv1, lv2, . . . ) for controlling the amplitude of a sine wave signal to be generated by the fundamental tone OSC, and such a slave volume parameter is defined for each key number. The amplitude of a sine wave signal to be generated by the fundamental tone OSC depends on master volume and slave volumes and a output level determined by a velocity curve indicated by velocity adjustment. A temporal variation characteristic (envelope) of the amplitude is controlled by the fundamental tone AEG. Normally, the slave volume in the second harmonic OSC-vs.-key table is set smaller than the slave volume in the fundamental tone OSC-vs.-key table, and the slave volume in the third harmonic OSC-vs.-key table and the slave volume in the fourth harmonic OSC-vs.-key table are set smaller than the slave volume in the second harmonic OSC-vs.-key table.

The parameter of the "phase" (phrase parameter) is a parameter (ph1, ph2, . . . ) for controlling the phase of a sine wave signal to be generated by the fundamental tone OSC, and such a phase parameter is defined for each key number. The parameter of the pitch (pitch parameter) is a parameter (ps1, ps2, . . . ) for shifting the frequency of a sine wave signal to be generated by the fundamental tone OSC from a frequency determined in the fundamental characteristic-vs.-key table, and such a pitch parameter is defined for each key number. Note that the sine wave signal defined by the fundamental OSC-vs.-key table and output from the fundamental tone OSC may be determined in any of various manners rather than being determined by a combination of the above-mentioned parameters.

FIG. 10 is a diagram explanatory of contents of the fundamental tone AEG-vs.-key table employed in the instant embodiment. The fundamental tone AEG-vs.-key table is a table defining, for each key number, a plurality of types of envelope-setting parameters (ADSR). In the illustrated example, the fundamental tone AEG-vs.-key table defines parameters of an attack time, decay time, decay level, sustain time and release time.

The parameter of the attack time (attack time parameters) is a parameter (at1, at2 . . . ) indicative of a time length from a key-on event time point till a time point when the amplitude of a sine wave signal is caused to reach a maximum amplitude (attack level), and such an attack time parameter is defined for each key number. The parameter of the decay time (decay time parameter) is a parameter (dt1, dt2 . . . ) indicative of a time length until the amplitude of a sine wave signal is caused to reach a decay level from an attack level, and such a decay time parameter is defined for each key number. The parameter of the sustain time (sustain time parameter) is a parameters (st1, st2, . . . ) indicative of a time length until the amplitude of a sine wave signal is caused to attenuate from the decay level down to a zero level when a key-on state has been maintained (i.e., there has been no key-off event), and such a sustain time parameter is defined for each key number. Further, the parameter of the release time (release time parameter) is a parameter (rt1, rt2, . . . ) indicative of a time length until the amplitude of a sine wave signal is caused to attenuate down to a zero level, and such a release time parameter is defined for each key number. Note that the envelope defined by the fundamental tone AEG-vs.-key table may be determined in any of various other manners rather than being determined by a combination of the aforementioned parameters.

Referring now back to FIG. 6, the sound generation control section 131 controls the respective behavior of the sine wave generation section 132 and envelope adjustment section 133 with reference to the individual tables in the setting information identified by the identification section 110 and on the basis of the tone control information output from the detection section 120. For example, once tone control information of a key number, velocity and key-on event is input, the sound generation control section 131 causes the sine wave generation section 132 to generate a sine wave signal and causes a driving waveform signal to be output, with reference to the setting information and using various parameters corresponding to the key number. Once tone control information of a key-off event is input, the sound generation control section 131 causes the sine wave generation section 132 to terminate generation of a sine wave signal.

Only one pair of the sine wave generation section 132 and the envelope adjustment section 133 are shown in FIG. 6, but, actually, a plurality of pairs of the sine wave generation sections 132 and the envelope adjustment sections 133 are provided. Thus, when keys of a plurality of key numbers are simultaneously in a key-on state according to the tone control information output from the detection section 120, one pair of the sine wave generation section 132 and the envelope adjustment section 133 are allocated in association with each of the key numbers. The sine wave signals output from the individual pairs of the sine wave generation sections 132 and envelope adjustment sections 133 are subjected to synthesis by the synthesis section 134.

Referring now back to FIG. 5, the setting section 200 is used when a character of a sine wave signal is to be set for determining an acoustic effect to be imparted by the acoustic effect impartment apparatus 100. The setting section 200 receives, via the touch panel 60, a user's operation for setting a character (e.g., amplitude or volume) of a sine wave signal defined by the setting information stored in the storage section 12. Further, by means of the control section 11, the setting section 200 stores, into the storage section 12, setting information defining the character of the sine wave signal having been set through the received user's operation. The setting section 200 may allow the user to set a desired character of a sine wave signal by the user changing or adjusting the contents of the setting information already stored in the storage section 12. Alternatively, the setting section 200 may allow the user to set a desired character of a sine wave signal by the user newly defining contents of setting information. In the former case, the contents of the setting information stored in the storage section 12 are updated in accordance with the user's changing/adjusting operation, while, in the latter case, the setting information defined by the user is newly stored into the storage section 12.

[Example Behavior]

Next, a description will be given about example behavior of the grand piano 1 employing the instant embodiment. First, the user operates the touch panel 60 to set the ordinary performance mode as the performance mode and set the acoustic effect imparting mode as the sound generation mode. Further, the user operates the touch panel 60 to select setting information of desired contents from among the plurality of setting information stored in the storage section 12.

In the following description, let it be assumed that the selected setting information is defined such that a driving waveform signal indicates vibration close to vibration of the actual strings 5. For example, the fundamental tone pitch in the fundamental characteristic-vs.-key table is set to coincide with the fundamental frequency of the string 5. Let it also be assumed that the inharmonicity too is set such that a sine wave signal having inharmonic frequencies of the second, third and fourth harmonics are included in the driving waveform signal. Let it also be assumed that parameters of an amplitude envelope of the driving waveform signal (or each sine wave signal) too are each set to generally coincide with a style of vibration attenuation of the strings 5. In the illustrated example, it is assumed that the master volume in the fundamental characteristic-vs.-key table of the selected setting information is set relatively at "0" (reference volume) for all of the key numbers. A specific example of a volume setting operation by the user will be described later.

As the user operates any one of the keys 2, the string 5 corresponding to the operated key 2 is struck by the hammer 4 to vibrate. Meanwhile, the detection section 120 identifies a time point at which the string 5 has been struck by the hammer 4, so that a driving waveform signal is output from the signal generation section 130. Thus, the vibration section 50 vibrates in accordance with the waveform indicated by the driving waveform signal, so that the soundboard 7 too vibrates and such vibration of the soundboard 7 is transmitted to the strings 5 via the bridge 6.

The driving waveform signal is a signal generated by synthesis of sine wave signals of the fundamental frequency of the string 5 having been struck by the hammer 4 and frequencies of the second, third and fourth harmonics of the hammer-struck string 5 taking inharmonicity taken into account.

Thus, the driving waveform signal is transmitted to the string 5 having been struck by the hammer 4 (i.e., hammer-struck string) more effectively than the other strings 5. Therefore, vibration of the string 5 is excited not only by the striking by the hammer 4 but also by the driving waveform signal, which thereby creates a state where an acoustic effect corresponding to the driving waveform signal has been imparted to the hammer-struck string 5. Because the driving waveform signal transmitted to the string 5 of which vibration has been excited by the striking by the hammer 4 comprises simple sine wave signals of the fundamental frequency and harmonic frequencies of the string 5, it does not contain superfluous frequency components like those found in sampled sounds of a piano or the like. Therefore, even through the driving waveform signal is transmitted to the string 5, a natural feeling of the acoustic piano will not be lost.

The following describe a specific example of a volume setting operation (amplitude adjustment) performed by the user on a feedback vibrating sine wave signal. Here, the volume setting operation will be described in relation to a case where the user has instructed setting of a master volume for each key number in the fundamental characteristic-vs.-key table. Namely, the user enters an instruction for setting an acoustic effect to be imparted by the acoustic effect impartment apparatus 100. In response to such a user's instruction for setting a master volume for each key number, the setting section 200 causes a setting screen to be displayed on the touch panel 60 as shown in FIG. 13A by means of the control section 11.

Figure 13A:
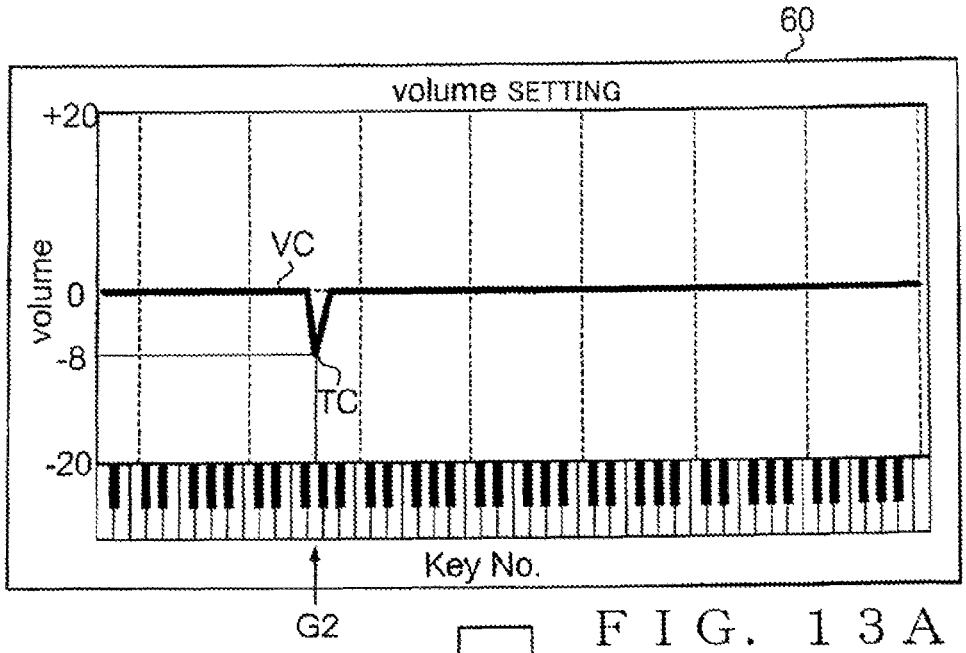
FIGS. 13A and 13B are diagrams explanatory of an example of a setting screen displayed on a touch panel in the embodiment of the present invention.

On the setting screen shown in FIG. 13A, an image of a keyboard is displayed in a horizontal axis direction, and positions of individual key numbers in the horizontal direction can be identified based on the displayed keyboard image. In the illustrated example, where the setting screen is intended to set a master volume, a vertical axis represents master volume values. A line VC, representing master volume settings, indicates master volume values in the fundamental characteristic-vs.-key table with "0" used as a reference value of volume adjustment. The volume value (amplitude of a sine wave signal) increases from the reference value as a position along the vertical axis changes in a positive (plus) direction along the vertical axis, while the volume value decreases from the reference value as a position along the vertical axis changes in a negative (minus) direction along the vertical axis. The unit used to indicate the volume value on the vertical axis may be one indicative of a gain amount from the reference value (volume ratio to the reference value) or one indicative of an offset amount (volume difference) from the reference value. Any keys for which no volume adjustment has been made by the user are set at the reference value of "0".

Figure 13B:
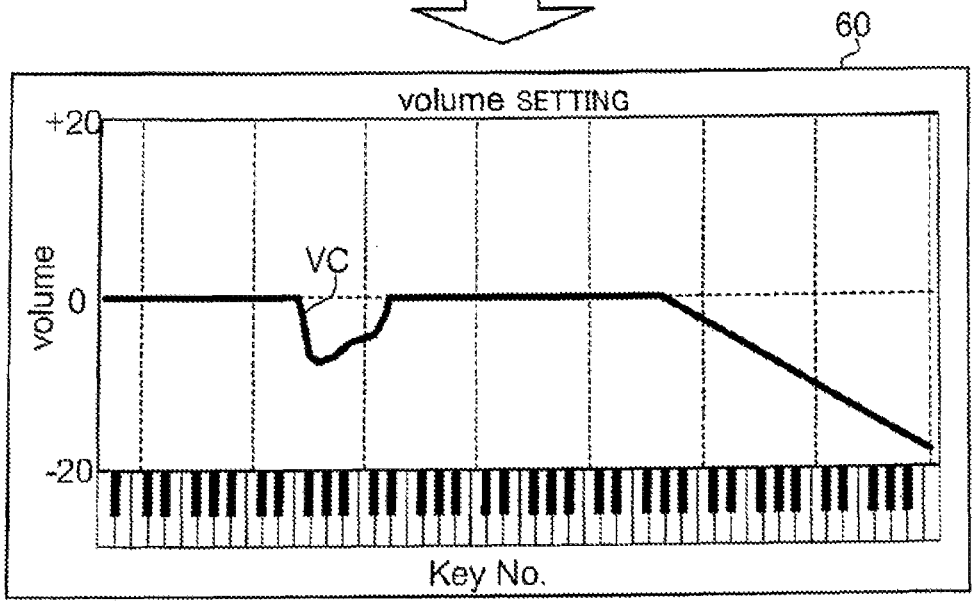

By the user touching a desired point on the touch panel 60 with its (his or her) finger, a volume value corresponding to a position, in the vertical axis direction, of the touched point can be set as a master volume for a key number corresponding to a position, in the horizontal axis direction, of the touched point. Namely, the user can set an amplitude adjustment value of a feedback vibrating waveform to the string 5 corresponding to that key number. For example, in response to the user touching a given point TC, a volume value "−8" corresponding to a position, in the vertical axis direction, of the touched point TC is set as the master volume for key number "G2" corresponding to a position, in the horizontal axis direction, of the touched point TC, as shown in FIG. 13A. In the illustrated example, it is assumed that the user has ultimately set relationship between individual key numbers and master volumes as shown in FIG. 13B.

Once the relationship between key numbers and master volumes is set in the aforementioned manner, the setting section 200 stores setting information indicative of the thus-set relationship between the key numbers and the master volumes into the storage section 12. The storage may be by updating setting information already stored in the storage section 12 with the new setting information, or by separately storing the new setting information.

In performing the aforementioned setting operation, the user may be allowed to operate a given one of the keys 2 in order to test-listen to a sound generated in accordance with the setting made for the given key 2. In this case, the user may be allowed to test-listen to both a sound based on vibration excited by striking of the string 5 with (by) the hammer 4 and an effect sound based on vibration of the soundboard excited by the driving waveform signal. Alternatively, the user may be allowed to test-listen to only the effect sound, based on vibration of the soundboard excited by the driving waveform signal, with the hammer 4 prevented by the stopper 40 from striking the string 5, by setting the operation mode in the silencing sound generation mode. Namely, the user may perform the aforementioned setting operation by trial and error, i.e. by effecting test-listening per key 2 such that a sound of the key 2 can be audibly generated with a desired volume.

As an example, relationship between key numbers and master volumes (i.e., key scaling characteristics of amplitudes (or amplitude key scaling characteristics) of sine wave signals to be used as vibrating waveforms that are transmitted to the individual strings 5 on the basis of the driving waveform signal) may be set taking into account transmission characteristics of driving waveform signals to the individual strings 5 in the signal transmission section 140. The "transmission characteristics" refer to particular frequency characteristics possessed by electric and mechanical signal and vibration transmission paths (feedback transmission paths) due to influences of the shape of the soundboard 7, mounted position of the vibration section 50, etc. In other words, the "transmission characteristics" are frequency characteristics of vibration transmission from the signal generation section 130 to the individual strings 5 via the vibration section 50 and vibration transmission structures 6 and 7. In the illustrated example, relationship between the key numbers and the master volumes is determined in such a manner as to cancel out peak portions (i.e., resonant portions) in the frequency characteristics. Namely, when any one of the keys 5 in peak frequency bands in the frequency characteristics of the feedback transmission paths has been struck by the corresponding hammer, an amplitude of sine wave feedback vibration to that string 5 would become increase as compared to when any one of the keys 5 in other than the peak frequency bands has been struck, and thus, relationship between key numbers and master volumes is set in such a manner as to cancel such increase in the amplitude sine wave feedback vibration. In the illustrated example of FIG. 13A, such relationship appears in a dip shape near key number "G2".

When parameters of setting information identified by the identification section 110 have been updated by the setting section 200 in the aforementioned manner, the signal generation section 130 generates the driving waveform signal by use of the above-mentioned parameter-updated setting information.

By setting the relationship between key numbers and master volumes as in the example of FIG. 13B, vibration based on the driving waveform signal is transmitted to the individual strings 5 with influences of frequency characteristics in the signal transmission section 140 suppressed or eliminated. Therefore, according to the instant embodiment, no matter which one of the keys in various frequency bands is operated, an acoustic effect can be imparted with a generally same volume with influences of frequency characteristics in the signal transmission section 140 eliminated, as long as the key is operated with a generally same velocity. In this way, good control performance or controllability can be achieved.

Further, because characters of sine wave signals contained in the driving waveform signal can be set variously and stored in accordance with a user's instruction, it is possible to create a plurality of templates in advance in association with acoustic effects of various characteristics. Further, even where the aforementioned acoustic effect impartment apparatus 100 is employed in grand pianos 1 differing from each other in the vibration characteristics of the soundboard 7, fundamental frequencies of the keys 5, etc., it is possible to freely change the contents of the setting information in accordance with such various characteristics.

The aforementioned key scaling characteristics of amplitudes of sine wave signals to be used as vibrating waveforms may be designed to provide key scaling for each group of a plurality of keys (i.e., for each of different key ranges) rather than key scaling for each key 2 (i.e., for each string 5). Furthermore, with the features of the present invention focusing on amplitude key scaling of vibrating waveforms, the driving waveform signal that drives the vibration section 50 allows the present invention to be practiced advantageously, even where the driving waveform signal is of any other waveform than the aforementioned sine waveform.

[Modifications]

Whereas the preceding paragraphs have described a preferred embodiment of the present invention, the present invention can be practiced in various other manners as set forth below.

<Modification 1>

Figure 11:
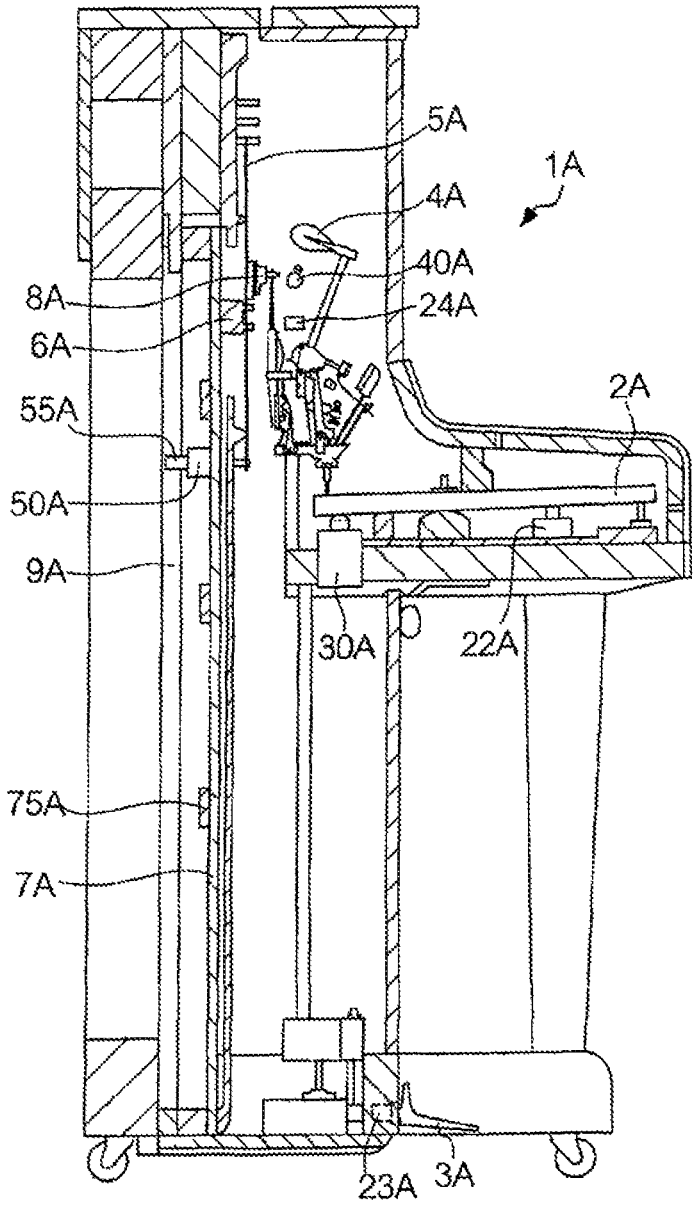
FIG. 11 is a view showing an inner construction of an upright piano employing modification 1 of the present invention.

Whereas the preferred embodiment of the acoustic effect impartment apparatus 100 of the present invention has been described above as applied to a grand piano, it may be applied to an upright piano. FIG. 11 is a view showing an inner construction of an upright piano 1A which employs modification 1 of the present invention is applied. In FIG. 11, elements of the upright piano 1A similar to the elements of the grand piano 1 are indicated by the same reference numerals as used for the grand piano 1 but each with suffix "A". In the upright piano 1A too, the vibration section 50A is fixedly supported by the support section 55A connected to the strut 9A, and the vibration section 50A is also connected to a portion of the soundboard 7A between the bracing members 75A. Thus, in the illustrated example of FIG. 11 too, a driving waveform signal generated in response to striking of any one of the strings 5A with the corresponding hammer 4 is transmitted to the strings 5A via the soundboard 7A and bridge 6A through vibration of the vibration section 50A. As seen from the above, the acoustic effect impartment apparatus 100 of the present invention is applicable to various acoustic pianos, such as a grand piano, upright piano, etc.

<Modification 2>

Whereas, in the above-described preferred embodiment, the signal transmission section 140 for transmitting the driving waveform signal to the strings 5 comprises the vibration section 50, the soundboard 7 and the bridge 6, the signal transmission section 140 may be constructed in any other suitable manner. For example, the vibration section 50 may be mounted to the bridge 6 so that the driving waveform signal is transmitted to the strings 5 through vibration, by the vibration section 50, of the bridge 6. In such a case, the signal transmission section 140 comprises the vibration section 50 and the bridge 6. Alternatively, the driving waveform signal may be transmitted directly to the strings 5, in which case the following construction may be employed.

Figure 12:
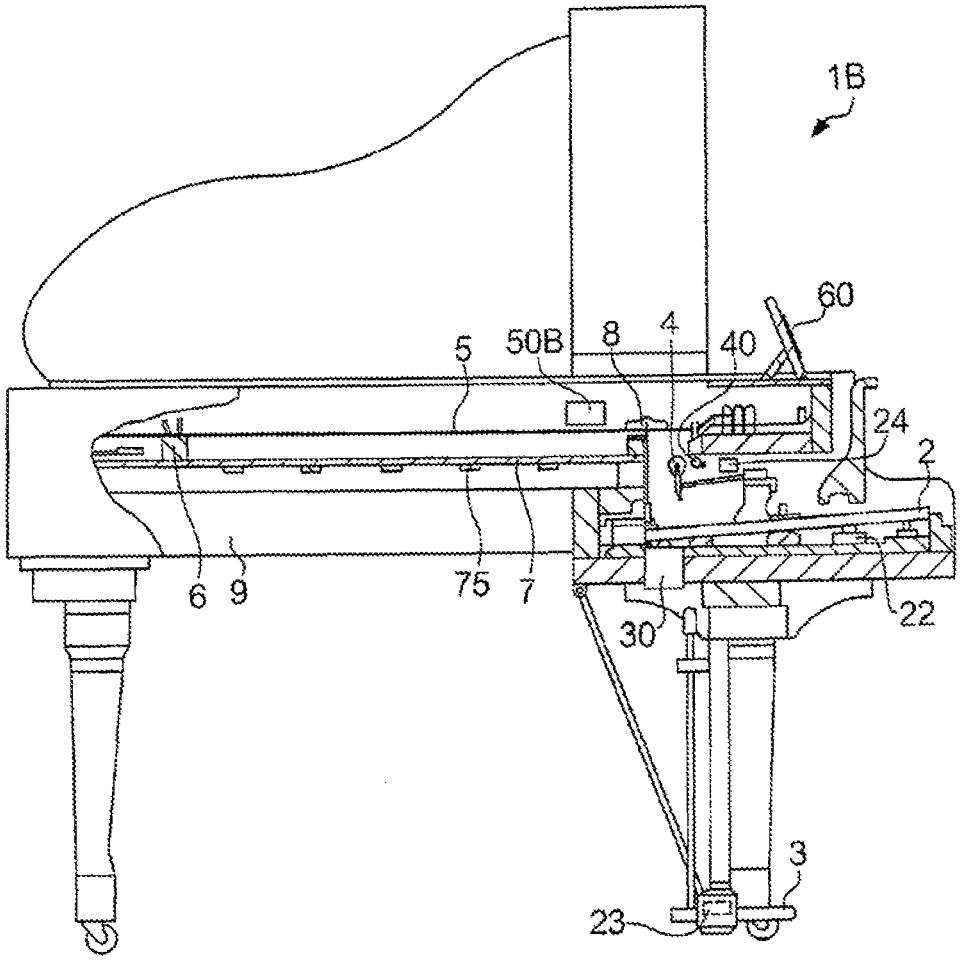
FIG. 12 is a view showing an inner construction of a grand piano employing modification 2 of the present invention.

FIG. 12 is a view showing an inner construction of a grand piano 1B to which modification 2 of the present invention is applied. In the illustrated example of FIG. 12, the signal transmission section 140 comprises a driving magnet 50B that is an electromagnet. The driving magnet 50B produces magnetic force of an intensity corresponding to a waveform indicated by the driving waveform signal input from the signal generation section 130. Through the production of the magnetic force from the driving magnet 50B, the driving waveform signal is transmitted to the strings 5 by vibration based on the waveform indicated by the driving waveform signal being excited. The driving magnet 50B only has to be provided to exert magnetic force on all of the strings 5 corresponding to the individual keys 2. Alternatively, a plurality of the driving magnets 50B may be provided in corresponding relation to the strings 5 in such a manner that vibration is excited for each of the strings 5. In this case, the signal generation section 130 only has to output a driving waveform signal to one of the driving magnets 50B that excites vibration in the key 5 corresponding to a given key number.

<Modification 3>

Whereas the preferred embodiment has been described above in relation to the case where a plurality of types of setting information are stored in the storage section 12, only one type of setting information may be stored in the storage section 12. In this case, the identification section 110 can be omitted or dispensed with because the signal generation section 130 only has to use the setting information stored in the storage section 12.

<Modification 4>

In the above-described preferred embodiment, tuning and temperaments may be associated with the plurality of types of setting information stored in the storage section 12. For example, setting information for equal temperament and setting information for just intonation may be stored in the storage section 12. Different setting information for just intonation should be stored for each key note, i.e. for each key scale. Thus, when the piano has been tuned, the user only has to select one of the setting information corresponding to the tuned temperament.

<Modification 5>

Whereas the sine wave generation section 132 in the preferred embodiment has been described above as including the fundamental tone OSC, second harmonic OSC, third harmonic OSC and fourth harmonic OSC, it may include more or less than the four OSCs. Namely, the sine wave generation section 132 only has to include at least one n (n is an integral number of one or more)-th harmonic OSC; in other words, the sine wave generation section 132 only has to be constructed to generate at least one sine wave signal having a frequency based on the fundamental tone frequency of a hammer-struck string. Alternatively, the sine wave generation section 132 may include only the fundamental tone OSC. In the case where the sine wave generation section 132 includes only the fundamental tone OSC like this, only a sine wave signal of the fundamental frequency of the string 5 is generated as the driving waveform signal; note, however, that, of the string 5 to which the driving waveform signal is transmitted, harmonic components too, rather than only a vibrating component of the fundamental frequency, increase due to energy of the driving waveform signal.

<Modification 6>

Whereas, in the above-described preferred embodiment, the setting information selected by the user is designed to generate sine wave signals of the fundamental frequency of the hammer-struck string 5 and frequencies of the second, third and fourth harmonics taking inharmonicity taken into account, the setting information is not limited to the one designed to generate sine wave signals in the aforementioned manner. In such a case, an acoustic effect different from the acoustic effect described above in relation to the preferred embodiment will be imparted depending on the setting information, but the user only has to select suitable setting information corresponding to a desired acoustic effect. The following describe examples of sine wave signals to be generated in accordance with the setting information.

As a first example, the sine wave signal of the fundamental frequency may be the same as in the above-described preferred embodiment, and the sine wave signals of the frequencies of the second, third and fourth harmonics may have frequencies two times, three times and four times of the fundamental frequency without inharmonicity taken into account. In this case, for the fundamental frequency of a driving waveform signal generated in connection with a given string 5, a sine wave signal matching the fundamental frequency contained in an actual vibration sound of the string 5 will be output, while, for the harmonics, sine wave signals of frequencies differing, by amounts corresponding to influences of inharmonicity, from frequencies of harmonics contained in the actual vibration sound of the string 5 will be output.

As a second example, the frequencies of the individual sine wave signals may be shifted collectively from respective ones of the fundamental tone frequency and harmonic frequencies.

As a third example, only sine wave signals may be output from the second harmonic OSC, third harmonic OSC and fourth harmonic OSC without a sine wave signal being output from the fundamental tone OSC. In this case, the driving waveform signal transmitted (fed back) to the hammer-struck string 5 does not contain a sine wave signal of the fundamental frequency. Note that frequencies of the sine wave signals output from the second harmonic OSC, third harmonic OSC and fourth harmonic OSC may be frequencies that do not take inharmonicity into account.

As long as setting information is set such that frequencies of the sine wave signals output from the individual OSCs are determined in association with the fundamental frequency of the string 5 as shown in each of the aforementioned examples, various other examples are also applicable. Various acoustic effects can be imparted using such various setting information.

Of various characteristics of sine wave signals defined by each of the setting information, any other desired type of parameter than the above-mentioned frequency, mater volume and slave volume may be made different in value from values defined by other setting information. Further, whereas the setting section 200 in the above-described preferred embodiment is constructed to set relationship between key numbers and master volumes, it may set various other parameters. When relationship between key numbers and values of another parameter is to be set, for example, it is only necessary that setting screens of FIGS. 13A and 13B be displayed on the touch panel 60 with the parameter to be set represented on the vertical axis. By thus making settings of various parameters, it is possible to impart various acoustic effects.

<Modification 7>

Whereas, in the above-described preferred embodiment, the plurality of vibration sections 50 are each constructed to vibrate in response to a same driving waveform signal, they may be constructed to vibrate in response to different driving waveform signals. For example, the vibration sections 50 have their respective actuators differing from each other in frequency dependence of a vibration characteristic. In such a case, the signal generation section 130 may be constructed to output each sine wave signal, generated by the sine wave generation section 132, to one of the vibration sections 50 which has the actuator that vibrates efficiently at the frequency of the sine wave signal.

Further, the vibration sections 50 may be arranged along the direction where the strings 5 are arranged (string-arranged direction). In this case, the signal generation section 130 may be constructed to output, to the vibration section 50 nearest to the string 5 struck by the hammer 4, a driving waveform signal output in association with that string 5.

<Modification 8>

In the above-described embodiment, the envelope adjustment section 133 includes the fundamental tone AEG, second harmonic AEG, third harmonic AEG and fourth harmonic AEG provided in corresponding relation to the fundamental tone OSC, second harmonic OSC, third harmonic OSC and fourth harmonic OSC and is capable of envelope adjustment in association with sine wave signals of the individual frequencies. As a modification, each of the AEGs may be constructed to perform adjustment of a same envelope. In this case, a construction may be provided for adjusting an envelope of a driving waveform signal output from the synthesis section 134 without using the envelope adjustment section 133.

<Modification 9>

The setting information in the preferred embodiment has been described as defining various parameters, such as frequencies of sine wave signals, in a table form. As a modification, the setting information may define various parameters in any other suitable form, such as in mathematical expressions using key numbers as variables.

<Modification 10>

Whereas the detection section 120 in the preferred embodiment has been described above as detecting behavior of any one of the keys 2 or hammers 4 to identify a time point of striking, by the hammer 4, of the string 5, such a string striking time point may be detected in any other suitable manner. For example, the detection section 120 may detect vibration of the string 5, caused by striking with the hammer 4, by means of one of piezoelectric or magnetic pickups provided in corresponding relation to the strings 5, identify the key number of the key 2 corresponding to the string 5 whose vibration has been detected as above, and then identify the time point of the detected vibration as a hammer-struck time point of the string 5. Alternatively, the detection section 120 may detect a sound, generated through vibration of the string 5, by means of a microphone or the like, identify the vibrated string 5 through analysis of a frequency distribution of the sound, and then identify a key number and hammer-struck time point of the key 2.

<Modification 11>

Whereas the setting section 200 in the preferred embodiment has been described above setting, in response to user's operation on the touch panel 60, relationship between key numbers and master volumes (amplitude key scaling characteristics) in setting information of sine wave signals, such relationship may be set in any other suitable manner. As one example, the setting section 200 may, in accordance with a user-input instruction (automatic setting instruction), generate a measurement signal, transmit mechanical vibration based on the measurement signal to the strings 5 via the signal transmission section 140, monitor vibration of each of the strings 5 having responded to the mechanical vibration and then set relationship between key numbers and master volumes on the basis of the monitored results. The following describe a construction of this modification with reference to FIGS. 14 and 15.

Figure 14:
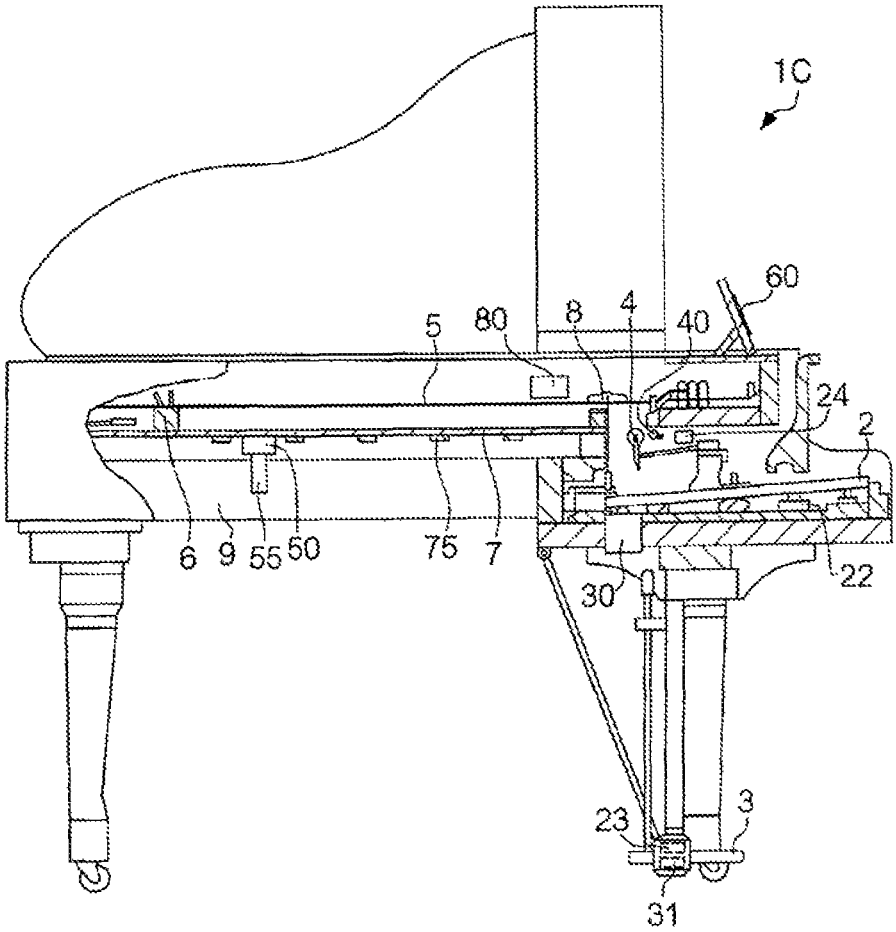
FIG. 14 is a view explanatory of an inner construction of a grand piano employing modification 11 of the present invention.

FIG. 14 is a view explanatory of an inner construction of a grand piano 1C employing modification 11 of the present invention. The grand piano 1C includes, in addition to the elements of the preferred embodiment, a microphone 80 for picking up sounds generated through vibration of the strings 5 and a pedal drive section 31. The microphone 80 is connected to the sound generator device 10 via the interface 16 to output a picked-up sound signal, indicative of content picked up thereby, to the sound generator device 10. If the grand piano 1C is constructed to be capable of detecting vibration of the strings 5, any of various other vibration detection means, such as a piezoelectric or magnetic pickup, rather than a sound pickup like the microphone 80 may be used; the same can be said for modifications 12 and 13 to be described later.

The pedal drive section 31 is connected to the sound generator device 10 via the interface 16 to drive or depress the pedal 3 in accordance with a control signal given from the sound generator device 10. In this manner, the sound generator device 10 controls the state of contact between the dampers 8 and the strings 5. Because it is only necessary that the state of contact between the dampers 8 and the strings 5 can be controlled, the dampers 8 may be driven directly without intervention of the pedal 3. The same can be said for modification 13 to be described later.

In implementing modification 13 including the microphone 80 and pedal drive section 31, it is needless to say that these components 80 and 31 should be added to the block diagram shown in FIG. 4, although not particularly shown.

Figure 15:
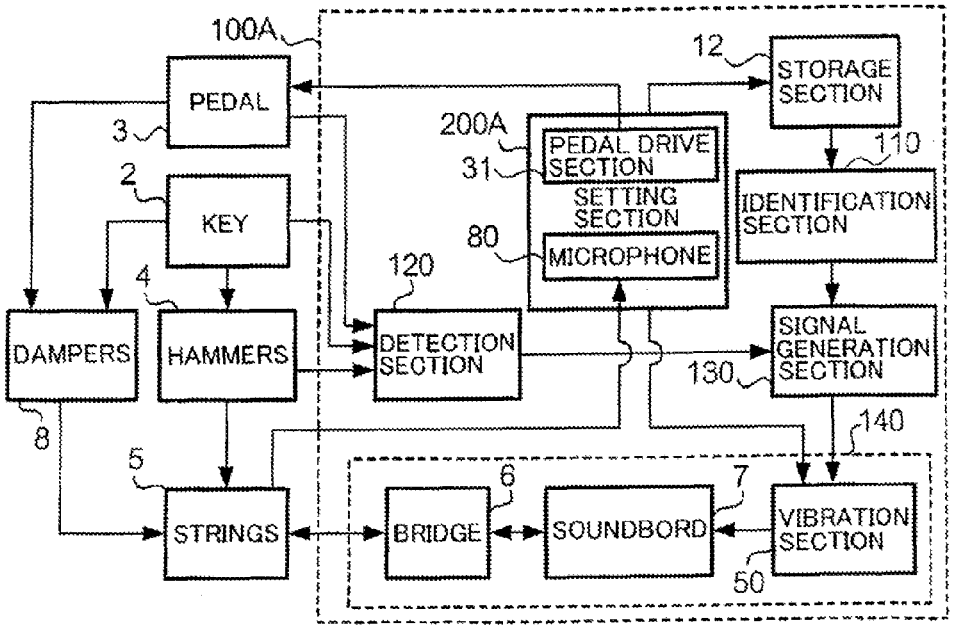
FIG. 15 is a block diagram showing a functional construction of modification 11 of the present invention.

FIG. 15 is a block diagram showing a functional construction of an acoustic effect impartment apparatus 100A according to modification 11 of the present invention. The acoustic effect impartment apparatus 100A includes a setting section 200A differing in construction from the setting section 200 provided in the above-described preferred embodiment. The setting section 200A detects vibration of the strings 5 by means of the microphone 80 (vibration detection device), and it also controls the state of contact between the dampers 8 and the strings 5 by means of the pedal drive section 31.

In accordance with a user-input instruction (automatic setting instruction), the setting section 200A causes the waveform generation section 15 to generate a measurement signal and outputs the thus-generated measurement signal to the vibration section 50 so that the vibration section 50 vibrates in response to the measurement signal. In the illustrated example, the measurement signal is in the form of white noise. At that time, the setting section 200A drives the pedal 3 to place the dampers 8 and the strings 5 out of contact with each other (i.e., in a mutually-non-contacting state). Also, the setting section 200A picks up, by means of the microphone 80, sounds generated by vibration of the string 5 and then calculates (analyzes) frequency characteristics in the signal transmission section 140 on the basis of a frequency distribution of the picked-up sound signals. Further, the setting section 200A sets relationship between key numbers and master volumes in setting information by means of the control section 11 in such a manner as to correspond to inverse characteristics of the frequency characteristics. At that time, frequency values of the frequency characteristics are set to correspond to the fundamental frequencies of the strings 5 corresponding to the key numbers. Such setting can create setting information corresponding to the example of FIG. 13B described above in relation to example behavior of the preferred embodiment.

Using the inverse characteristics of the calculated frequency characteristics, it is possible to reduce influences, such as peaks of the frequency characteristics in the signal transmission section 140. However, such inverse characteristics of the calculated frequency characteristics are not necessarily essential, and it is only necessary that relationship between key numbers and master volumes in setting information be set so that a driving waveform signal of predetermined frequency characteristics is transmitted to the strings 5. Namely, the relationship between key numbers and master volumes may be set in such a manner as to correct frequency characteristics in accordance with an acoustic effect to be imparted, rather than being set in such a manner that a driving waveform signal is transmitted to the strings 5 in such a manner as to cancel out influences, such as peaks of the frequency characteristics in the signal transmission section 140. The same can be said for the case where relationship between key numbers and master volumes is set by the user as in the above-described preferred embodiment, as well as for modifications 12 and 13 to be described later.

Further, the measurement signal need not necessarily be in the form of white noise, as long as it is a signal indicative of a sound distributed in a frequency band of a given range. Further, the setting section 200A may output measurement signals of different frequency bands in different time periods and set, in association with output of the individual measurement signals, relationship between key numbers of frequency values included in the frequency bands of the measurement signals and master volumes.

<Modification 12>

The following describe an acoustic effect impartment apparatus 100B which, in the grand piano 1C having the construction of FIG. 14, sets relationship between key numbers and master volumes in a different manner from the acoustic effect impartment apparatus 100A according to modification 11 of the present invention.

Figure 16:
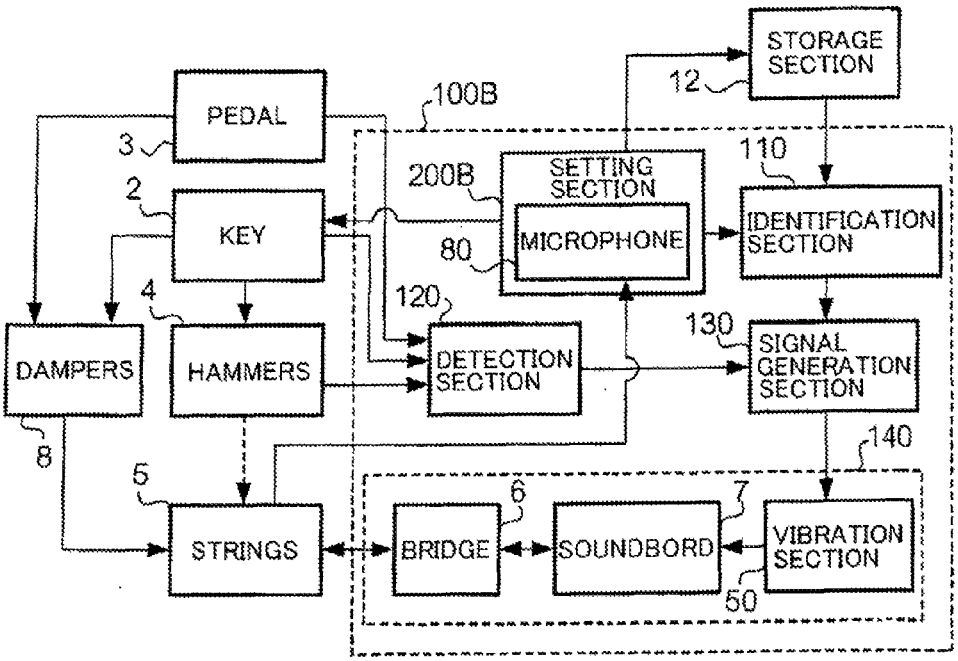
FIG. 16 is a block diagram showing a functional construction of modification 12 of the present invention.

FIG. 16 is a block diagram showing a functional construction of the acoustic effect impartment apparatus 100B according to modification 12 of the present invention. In accordance with a user-input instruction (automatic setting instruction), the setting section 200B sequentially drives the keys 2 by means of the key drive section 30 and transmits a driving waveform signal, output from the signal generation section 130 in response to the sequential driving of the keys 2, to the strings 5. At that time the setting section 200B drives the stopper 40 in such a manner as to prevent the hammers 4 from striking the strings 5 (in the silencing sound generation mode). Thus, the strings 5 vibrate in response to the driving waveform signals (measurement signals), transmitted by the signal transmission section 140, without being struck by the hammers 4. Because the dampers 8 too are driven together with the driven keys 2, the pedal drive section 31 provided in modification 11 may be dispensed with in modification 12.

Further, the setting section 200B causes the identification section 110 to identify setting information for measurement signals to be used in the signal generation section 130. The "setting information for measurement signals" is setting information of which driving waveform signals (measurement signals) are sine wave signal of the fundamental frequency of the strings 5 corresponding to the driven keys 2, and which is prescribed in such a manner that maximum amplitude values of the sine wave signals are maintained constant no matter which of the keys 2 has been driven. Namely, in the illustrated example, the driving waveform signal (measurement signal) does not contain sine wave signals generated from the second harmonic OSC, third harmonic OSC and fourth harmonic OSC.

The setting section 200B picks up, by means of the microphone 80, generated sounds of the strings 5 that have vibrated in response to the driving waveform signals (measurement signals) transmitted to the strings 5 in response to driving of the individual keys 2, and then it sets, by means of the control section 11, master volumes corresponding to the key numbers of the driven keys 2 on the basis of maximum amplitudes of picked-up sound signals. For example, in order to transmit driving waveform signals to the keys 5 in such a manner as to cancel out peaks etc. of frequency characteristics in the signal transmission section 140, the setting section 200B may set the master volume in question at "0" (reference volume) if the maximum amplitude of the picked-up sound signal is of a predetermined value (that may be a value predetermined in correspondence with a velocity of the driven key 2) and may set the master volume in question at a smaller value the greater than the predetermined value is the maximum amplitude of the picked-up sound signal.

<Modification 13>

The following discuss an acoustic effect impartment apparatus 100C which, in the grand piano 1C having the construction of FIG. 14, sets relationship between key numbers and master volumes in a different manner from the acoustic effect impartment apparatus 100A according to modification 11 of the present invention and from the acoustic effect impartment apparatus 100B according to modification 12 of the present invention.

Figure 17:
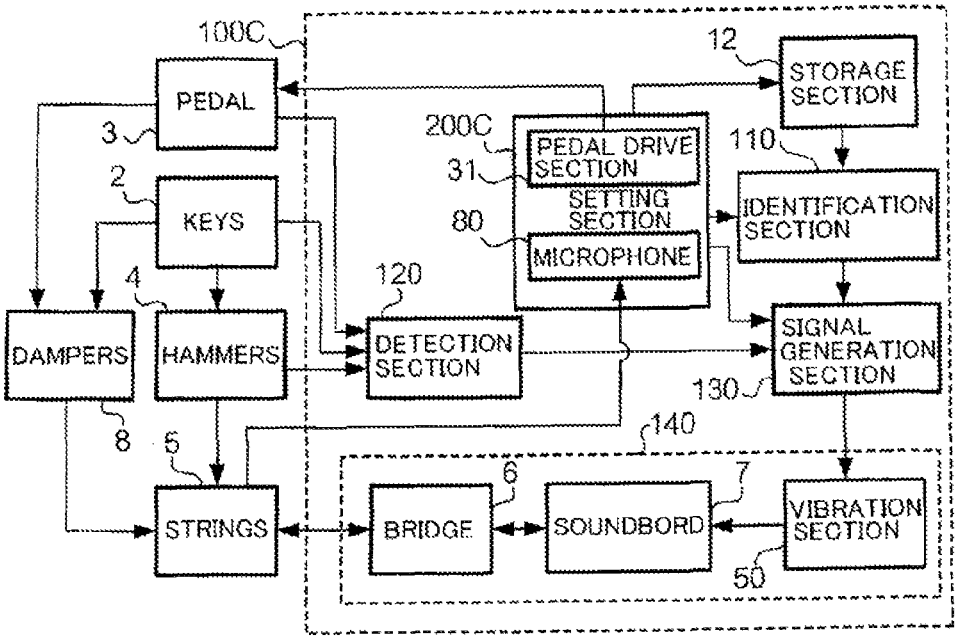
FIG. 17 is a block diagram showing a functional construction of modification 13 of the present invention.

FIG. 17 is a block diagram showing a functional construction of the acoustic effect impartment apparatus 100C according to modification 13 of the present invention. In response to a user-input instruction, the setting section 200C in the acoustic effect impartment apparatus 100C sequentially generates tone control information that would be output from the detection section 200 if the individual key 2 are sequentially driven, instead of inputting tone control information to the signal generation section 130 by sequentially driving the individual keys 2 as in modification 12 above, and then causes driving waveform signals to be sequentially generated from the signal generation section 130 in response to the sequential generation of the tone control information. Namely, the setting section 200C in the acoustic effect impartment apparatus 100C simulates a similar situation to where the individual keys 2 have been sequentially driven and causes the signal generation section 130 to sequentially generate driving waveform signals. At that time, the setting section 200C drives the pedal 3 to place the damper 8 and the strings 5 out of contact with each other (i.e., in the mutually-non-contacting state).

Because modification 13 is different from modification 12 only as to whether the tone control information is output from the detection section 120 as a result of driving the keys 2 or output from the setting section 200C, a description about other functions of the setting section 200C will be omitted.

<Modification 14>

Whereas the preferred embodiment and modifications of the present invention have been described above as setting master volume values in the fundamental characteristic-vs.-key table of the setting information in order to correct influences of frequency characteristics in the signal transmission section 140, the present invention is not so limited. A modification may be constructed to correct the influences of the frequency characteristics by use of any other parameter than the master volume as long as the other parameter is a parameter for adjusting the amplitude of the driving waveform signal (amplitude adjustment value). For example, the other parameter may be a slave volume (level) in the fundamental tone OSC-vs.key table and second, third and fourth harmonic OSC-vs.key tables. In this way, volume adjustment can be performed on respective sine wave signals output from the fundamental OSC, second harmonic OSC, third harmonic OSC and fourth harmonic OSC.

In this case, only a slave volume in any one of the fundamental tone OSC-vs.-key table, second harmonic OSC-vs.-key table, third harmonic OSC-vs.-key table and fourth harmonic OSC-vs.-key table may be set. For example, the construction of modifications 1, 2 and 3 may be modified to set relationship between key numbers and slave volumes in the fundamental tone OSC-vs.-key table and set predetermined relationship between key numbers and slave volumes in predetermined relationship (e.g., maintain all slave volumes at a reference volume of "0") in the second, third and fourth harmonic OSC-vs.-key tables, instead of setting relationship between key numbers and master volumes in the fundamental tone OSC-vs.-key table.

Further, when relationship between key numbers and slave volumes has been set in the fundamental tone OSC-vs.-key table, relationship between key numbers and slave volumes in the second, third and fourth harmonic OSC-vs.-key tables too may be set in any suitable manner. For example, slave volumes to be set for key numbers having frequencies related to frequencies of sine wave signals pertaining to individual harmonics may be set (applied by analogy) in consideration with the frequencies of sine wave signals. For example, when a slave volume corresponding to key number "A3" has been set, a slave volume corresponding to key number "A2" close to a frequency of the fundamental tone of key number "A3" may be set in association with such setting in the fundamental tone OSC-vs.-key table. Similarly, a slave volume corresponding to key number "A1" and a slave volume corresponding to key number "A0" may be set in the third and fourth harmonic OSC-vs.-key tables, respectively, in association with the setting in the fundamental tone OSC-vs.-key table. In this case, slave volumes may be set in the second, third and fourth harmonic OSC-vs.-key tables in predetermined relation (e.g., ratio) to the setting in the fundamental tone OSC-vs.-key table, instead of being set at same values as the slave volumes set in the fundamental tone OSC-vs.-key table.

<Modification 15>

Whereas the setting section 200 in the preferred embodiment has been described as displaying settings of an acoustic effect as a setting screen on the touch panel 60, such settings of an acoustic effect may be displayed using the keys 2. For example, the keys 2 may be actually driven to change positions, within a range from the rest position to the end position, of the keys 2.

Figure 18:
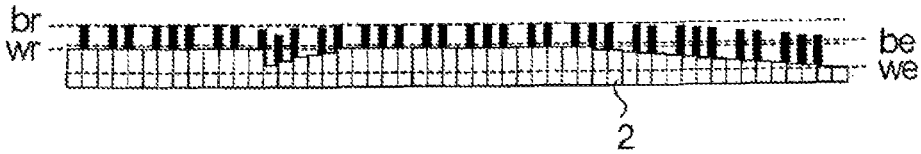
FIG. 18 is a diagram explanatory of positions of keys at the time of setting of an acoustic effect in modification 15 of the present invention.

FIG. 18 is a diagram explanatory of positions of keys 2 at the time of setting of an acoustic effect according to modification 15 of the invention. More specifically, FIG. 18 shows the keys 2 from the front of the grand piano 1, where the same relationship between key numbers and master volumes as shown in FIG. 13B is shown by respective positions of the keys 2. In FIG. 18, "br" indicates the rest position of the black key and "be" indicates the end position of the black key, while "wr" indicates the rest position of the white key and "we" indicates the end position of the white key.

In response to a user's operation received via the touch panel 60, the setting section 200 drives the key drive section 30 in accordance with the set relationship between key numbers and master volumes to thereby change the positions of the keys 2. For example, of parameters set in association with the individual key numbers, a maximum value and minimum value of parameters may be set to indicate the rest position and end position, respectively. At that time, the setting section 200 may drive the stoppers 40 to prevent the hammers 4 from striking the strings and prevent the signal generation section 130 from outputting a driving waveform signal, so that no sound is generated by the driving of the keys 2.

Note that any other suitable movable members than the keys 2 may be used as the elements indicative of the settings of an acoustic effect. For example, a pedal drive section (not shown) for driving the pedal 3 may be provided, and the setting section 200 may change the position of the pedal 3, in accordance with pedal-related settings, to thereby indicate the settings of an acoustic effect.

<Modification 16>

Whereas the preferred embodiment has been described above in relation to the case where the user operates the touch panel 60 to perform setting of an acoustic effect to be imparted, the user may perform setting of an acoustic effect by operating the keys 2. In such a case, the setting section 200 may identify a depth (i.e., an amount of movement from the rest position) of each operated key 2 on the basis of a detection signal from the key sensor 22 and set a parameter corresponding to the key number of the operated key 2 at a value corresponding to the identified depth. Note that timing at which the depth of the key 2 should be identified may be chosen from among various predetermined timing, such as when the user has operated the operation panel 13, when the user has pressed down the pedal 3, when a predetermined time has elapsed from the user's operation of the key 2, and the like.

Further, the user may designate a key number by operating any one of the keys 2, and a value of the parameter corresponding to the designated key number may be set in accordance with a pressed-down amount of the pedal 3. In this case, the setting section 200 identifies the operated key 2 on the basis of a detection signal from the key sensor 22 and identifies the pressed-down amount of the pedal 3 on the basis of a detection signal from the pedal sensor 23. Then, the setting section 200 may set the parameter, corresponding to the key number of the operated key 2, at a value corresponding to the identified pressed-down amount of the pedal 3. Note that timing at which the pressed-down amount of the pedal 3 should be identified may be chosen from among various predetermined timing, such as when the user has operated the operation panel 13, when the user has returned the operated key back to the rest position, when a predetermined time has elapsed from the user's operation of the pedal 3, and the like.

<Modification 17>

Various programs for use in the above-described embodiment may be provided stored in any of various computer-readable recording media, such as magnetic recording media (like a magnetic tape, magnetic disk, etc.), optical recording media (like an optical disk), magneto-optical recording media and semiconductor memories. Further, the grand piano 1 may download the various programs via a network.

This application is based on, and claims priorities to, JP PA 2011-200673 filed on 14 Sep. 2011, JP PA 2011-200674 filed on 14 Sep. 2011, JP PA 2011-200675 filed on 14 Sep. 2011, and JP PA 2011-200676 filed on 14 Sep. 2011. The disclosure of the priority applications, in its entirety, including the drawings, claims, and the specification thereof, are incorporated herein by reference.

What is claimed is:

1. An acoustic effect impartment apparatus for use in a piano that has a plurality of keys, a plurality of strings provided in corresponding relation to the keys, and a plurality of hammers each responsive to an operation of any one of the keys to strike the string corresponding to the key, the acoustic effect impartment apparatus comprising:

a detection section configured to detect striking of any one of the strings by a corresponding one of the hammers;

a signal generation section configured to generate, on the basis of a detection result of the detection section, at least one sine wave signal each consisting essentially of a simple waveform representing a frequency based on a fundamental frequency of the string struck by the hammer;

a vibration section configured to generate vibration corresponding to the at least one sine wave signal generated by the signal generation section; and a vibration transmission structure configured to transmit the vibration, generated by the vibration section, to the strings.

2. The acoustic effect impartment apparatus as claimed in claim 1, wherein the vibration transmission structure includes a soundboard of the piano and a bridge of the piano provided on the soundboard, and vibration of the vibration section corresponding to the at least one sine wave signal is transmitted to the strings.

3. The acoustic effect impartment apparatus as claimed in claim 1, wherein the frequency of the at least one sine wave signal is n, which is an integral number of one or more times higher than the fundamental frequency of the string struck by the hammer.

4. The acoustic effect impartment apparatus as claimed in claim 1, wherein the at least one sine wave signal further includes a second sine wave signal consisting essentially of a simple waveform of a harmonic frequency that is inharmonic to the fundamental frequency of the string struck by the hammer.

5. The acoustic effect impartment apparatus as claimed in claim 4, wherein the frequency of the second sine wave signal is greater by a value, predetermined depending on a note of the struck string, than a frequency that is m, which is an integral number of two or more times higher than the fundamental frequency of the string struck by the hammer.

6. The acoustic effect impartment apparatus as claimed in claim 1, wherein the at least one sine wave signal transmitted to the strings varies in amplitude over time with a characteristic predetermined in association with the string struck by the hammer.

7. The acoustic effect impartment apparatus as claimed in claim 1, further comprising:

a storage section storing a plurality of sets of setting information that define tuning of fundamental frequencies of individual ones of the keys; and an identification section configured to identify any one of the sets of setting information in accordance with a user's instruction, wherein the frequency of at least one sine wave signal is based on a fundamental frequency that is determined on the basis of the one set of setting information identified by the identification section.

8. The acoustic effect impartment apparatus as claimed in claim 1, further comprising:

a setting section configured to set, in association with each of the strings, an amplitude adjustment value for adjusting an amplitude of the at least one sine wave signal, wherein the vibration section generates, with the amplitude adjusted in accordance with the amplitude adjustment value, the vibration corresponding to the at least one sine wave signal.

9. The acoustic effect impartment apparatus as claimed in claim 8, wherein the setting section sets the amplitude adjustment value in response to a user's operation.

10. The acoustic effect impartment apparatus as claimed in claim 8, wherein the setting section sets the amplitude adjustment values corresponding to individual ones of the strings in accordance with a frequency characteristic of vibration transmission from the signal generation section to the strings via the vibration section and the vibration transmission structure.

11. The acoustic effect impartment apparatus as claimed in claim 10, wherein the setting section sets the amplitude adjustment values corresponding to the individual strings with an inverse characteristic of the frequency characteristic of vibration transmission.

12. The acoustic effect impartment apparatus as claimed in claim 1, further comprising:

a storage section storing setting information that defines a character of the at least one sine wave signal; and a setting section configured to set the character defined by the setting information stored in the storage section, wherein the at least one sine wave signal has the character defined by the setting information in association with the string struck by the hammer.

13. The acoustic effect impartment apparatus as claimed in claim 12, wherein:

the storage section stores a plurality of the setting information, the setting information defining the character set by the setting section being stored in the storage section, the acoustic effect impartment apparatus further comprises an identification section configured to identify, in accordance with a user's instruction, any one of the plurality of the setting information stored in the storage section, and the at least one sine wave signal has the character defined in the setting information identified by the identification section.

14. The acoustic effect impartment apparatus as claimed in claim 12, wherein:

the at least one sine wave comprises a plurality of sine wave signals, each consisting of a simple waveform, of different frequencies based on the fundamental frequency of the string struck by the hammer, the vibration section generates vibration corresponding to a synthesis of the plurality of the sine wave signals generated by the signal generation section, and the setting information defines a character of each of the plurality of the sine wave signals.

15. An acoustic effect impartment apparatus for use in a piano that has a plurality of keys, a plurality of strings provided in corresponding relation to the keys, and a plurality of hammers each responsive to an operation of any one of the keys to strike the string corresponding to the key, the acoustic effect impartment apparatus comprising:

a detection section configured to detect striking of any one of the strings by a corresponding one of the hammers;

a signal generation section configured to generate, on the basis of a detection result of the detection section, at least one sine wave signal representing a frequency based on a fundamental frequency of the string struck by the hammer;

a vibration section configured to generate vibration corresponding to the at least one sine wave signal generated by the signal generation section; and a vibration transmission structure configured to transmit the vibration, generated by the vibration section, to the strings;

a setting section configured to set, in association with each of the strings, an amplitude adjustment value for adjusting an amplitude of the at least one sine wave signal, wherein the vibration section generates, with the amplitude adjusted in accordance with the amplitude adjustment value, the vibration corresponding to the at least one sine wave signal, wherein the setting section sets the amplitude adjustment values corresponding to individual ones of the strings in accordance with a frequency characteristic of vibration transmission from the signal generation section to the strings via the vibration section and the vibration transmission structure, wherein the setting section includes a vibration detection device configured to detect vibration of the strings, and wherein the signal generation section further generates a measurement signal, wherein, in response to the measurement signal generated by the signal generation section, the vibration section generates the vibration, and the vibration transmission structure transmits the vibration, generated by the vibration section, to the string, and wherein, on the basis of detection by the vibration detection device of the vibration transmitted to the strings, the setting section analyzes the frequency characteristic of vibration transmission to the strings and sets the amplitude adjustment values corresponding to the individual strings in accordance with the analyzed frequency characteristic.

16. The acoustic effect impartment apparatus as claimed in claim 15, wherein the measurement signal is a sine wave signal generated for each of the strings and corresponding to the fundamental frequency of the string.

17. An acoustic piano comprising:

a plurality of keys;

a plurality of strings provided in corresponding relation to the keys;

a plurality of hammers each responsive to an operation of any one of the keys to strike the string corresponding to the key; and an acoustic effect impartment apparatus comprising:

a detection section configured to detect striking of any one of the strings by a corresponding one of the hammers;

a signal generation section configured to generate, on the basis of a detection result of the detection section, at least one sine wave signal each consisting essentially of a simple waveform representing a frequency based on a fundamental frequency of the string struck by the hammer;

a vibration section configured to generate vibration corresponding to the at least one sine wave signal generated by the signal generation section; and a vibration transmission structure configured to transmit the vibration, generated by the vibration section, to the strings.

18. An acoustic effect impartment apparatus for use in a piano including a plurality of keys, a plurality of strings provided in corresponding relation to the keys and a plurality of hammers each responsive to an operation of any one of the keys to strike the string corresponding to the key, the acoustic effect impartment apparatus comprising:

a detection section configured to detect striking of any one of the strings by a corresponding one of the hammers;

a signal generation section configured to generate, on the basis of a detection result of the detection section, at least one driving waveform signal each consisting essentially of a simple waveform representing a frequency based on a fundamental frequency of the string struck by the hammer;

a setting section configure to set, in association with the string of each of the keys, an amplitude adjustment value for adjusting an amplitude of the at least one driving waveform wave signal;

a vibration section configured to generate vibration corresponding to the at least one driving waveform signal adjusted in amplitude with the amplitude adjustment value; and a vibration transmission structure configured to transmit the vibration, generated by the vibration section, to the strings.

* * * * *